US007967660B2

(12) United States Patent
Fukuda et al.

(10) Patent No.: US 7,967,660 B2
(45) Date of Patent: Jun. 28, 2011

(54) POLISHING APPARATUS AND POLISHING METHOD

(75) Inventors: Akira Fukuda, Fujisawa (JP); Yoshihiro Mochizuki, Fujisawa (JP); Kazuto Hirokawa, Fujisawa (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 12/878,184

(22) Filed: Sep. 9, 2010

(65) Prior Publication Data

US 2011/0014851 A1 Jan. 20, 2011

Related U.S. Application Data

(62) Division of application No. 11/884,746, filed as application No. PCT/JP2005/016195 on Aug. 30, 2005.

(30) Foreign Application Priority Data

Feb. 25, 2005 (JP) ..... 2005-050481

(51) Int. Cl.
*B24B 49/00* (2006.01)
*B24B 51/00* (2006.01)

(52) U.S. Cl. ..... 451/5; 451/10; 451/11; 451/41; 451/59; 451/63; 451/288

(58) Field of Classification Search ..... 340/680; 451/5, 8, 9, 10, 11, 41, 59, 63, 285–290
See application file for complete search history.

(56) References Cited

U.S. PATENT DOCUMENTS

| | | | |
|---|---|---|---|
| 5,759,918 | A | 6/1998 | Hoshizaki et al. |
| 5,851,136 | A | 12/1998 | Lee |
| 5,908,530 | A | 6/1999 | Hoshizaki et al. |
| 5,938,884 | A | 8/1999 | Hoshizaki et al. |
| 6,019,868 | A | 2/2000 | Kimura et al. |
| 6,878,302 | B1 | 4/2005 | Corbellini et al. |
| 7,150,673 | B2 | 12/2006 | Sakurai et al. |
| 7,234,999 | B2 | 6/2007 | Sakurai et al. |
| 2002/0042246 | A1 | 4/2002 | Togawa et al. |

FOREIGN PATENT DOCUMENTS

| | | |
|---|---|---|
| CN | 1330581 | 1/2002 |
| EP | 0 861 706 | 9/1998 |

(Continued)

OTHER PUBLICATIONS

International Search Report issued Dec. 13, 2005 in International (PCT) Application No. PCT/JP2005/016195.

(Continued)

*Primary Examiner* — Timothy V Eley
(74) *Attorney, Agent, or Firm* — Wenderoth, Lind & Ponack, L.L.P.

(57) ABSTRACT

A polishing apparatus is provided for polishing wafers at a high yield rate even if roll-off exists. The polishing apparatus polishes a wafer by applying a pressure between a polishing member (polishing pad) 201 and the wafer held by a holding member (top ring) 52 and moving the polishing member relative to the wafer. The polishing apparatus includes a top ring 52 for holding the wafer, a pressure adjusting mechanism for adjusting a supporting pressure with which the wafer is supported on a supporting surface by a retainer ring, and a control unit for controlling the pressure adjusting mechanism to bring the supporting pressure to a desired pressure based on a roll off quantity of the wafer. The top ring comprises an air bag 202 for pressing the wafer against the polishing pad, a retainer ring which surrounds the wafer, and an air bag for pressing the retainer ring.

3 Claims, 27 Drawing Sheets

FOREIGN PATENT DOCUMENTS

| | | |
|---|---|---|
| JP | 63-245369 | 10/1988 |
| JP | 08-132342 | 5/1996 |
| JP | 10-235555 | 9/1998 |
| JP | 2001-244222 | 9/2001 |
| JP | 2001-261874 | 9/2001 |
| JP | 2002-075935 | 3/2002 |
| JP | 2002-134448 | 5/2002 |
| JP | 2002-157723 | 5/2002 |
| JP | 2002-187060 | 7/2002 |
| JP | 2002-200553 | 7/2002 |
| JP | 2003-229388 | 8/2003 |
| WO | 01/74532 | 10/2001 |

OTHER PUBLICATIONS

Chinese Office Action stamped Feb. 10, 2009 for Chinese Application No. 2005800487007 with translation.

Supplementary Partial European Search Report dated Oct. 28, 2009 in corresponding European Application No. 05776860.

(b)

(a)

TO MOTORS IN OTHER COMPONENTS AND PRESSURE ADJUSTING MECHANISM
STORAGE MEDIUM
209
CONTROL UNIT
208
DISPLACEMENT GAGE
103
PRESSURE ADJUSTING MECHANISM
806
PRESSURE ADJUSTING MECHANISM
206
A
C
W
205
Z4
Z3
Z2
Z1
Z2
Z3
Z4
802
204
203
52
B
201
207
54

(RETAINER RING PRESSURE, PRESSING SURFACE CONTACT PRESSURE [kPa]

*Fig. 20*

| MODULUS OF ELASTICITY OF PAD [MPa] | THICKNESS OF PAD [mm] | MAXIMUM POLISHING RATE (RELATIVE VALUE) | MINIMUM POLISHING RATE (RELATIVE VALUE) |
|---|---|---|---|
| 30. 25 | 2. 75 | 1. 026 | 0. 945 |
| 22. 50 | 3. 00 | 1. 003 | 0. 947 |
| 30. 00 | 4. 34 | 1. 049 | 0. 947 |
| 35. 00 | 3. 62 | 1. 052 | 0. 940 |
| 22. 50 | 1. 75 | 1. 003 | 0. 943 |
| 5. 00 | 3. 00 | 1. 005 | 0. 908 |
| 15. 00 | 5. 00 | 1. 003 | 0. 934 |
| 50. 00 | 3. 62 | 1. 092 | 0. 927 |

SUITABLE RANGES FOR MODULUS OF ELASTICITY OF UPPER PAD LAYER AND THICKNESS OF UPPER PAD LAYER IN TWO-LAYER PAD (MODULUS OF ELASTICITY OF LOWER PAD LAYER : 12 [MPA])

SUITABLE RANGES FOR MODULUS OF ELASTICITY OF LOWER PAD LAYER AND THICKNESS OF UPPER PAD LAYER IN TWO-LAYER PAD (MODULUS OF ELASTICITY OF UPPER PAD LAYER : 10 [MPA])

SUITABLE RANGES FOR MODULUS OF ELASTICITY OF UPPER PAD LAYER AND THICKNESS OF UPPER PAD LAYER IN TWO-LAYER PAD (MODULUS OF ELASTICITY OF LOWER PAD LAYER : 12 (MPA))

MORE SUITABLE RANGES FOR MODULUS OF ELASTICITY OF LOWER PAD LAYER AND THICKNESS OF UPPER PAD LAYER IN TWO-LAYER PAD (MODULUS OF ELASTICITY OF UPPER PAD LAYER : 10 [MPA])

Fig. 25

| MODULUS OF ELASTICITY OF UPPER PAD LAYER [MPa] | MODULUS OF ELASTICITY OF LOWER PAD LAYER [MPa] | THICKNESS OF UPPER PAD LAYER [mm] | MAXIMUM POLISHING RATE (RELATIVE VALUE) | MINIMUM POLISHING RATE (RELATIVE VALUE) |
|---|---|---|---|---|
| 10.0 | 12.0 | 4.0 | 1.002 | 0.964 |
| 35.0 | 12.0 | 1.0 | 1.040 | 0.987 |
| 12.0 | 12.0 | 8.0 | 1.022 | 0.947 |
| 22.0 | 12.0 | 4.0 | 1.071 | 0.970 |
| 22.0 | 12.0 | 10.0 | 1.087 | 0.951 |
| 10.0 | 20.0 | 1.0 | 1.016 | 0.987 |
| 10.0 | 5.0 | 7.0 | 1.013 | 0.941 |
| 10.0 | 22.0 | 4.0 | 1.001 | 0.968 |
| 10.0 | 5.0 | 4.0 | 1.007 | 0.951 |
| 10.0 | 1.0 | 10.0 | 1.040 | 0.907 |

POLISHING APPARATUS AND POLISHING METHOD

This application is a Divisional of U.S. application Ser. No. 11/884,746, filed Aug. 21, 2007, which is a national stage application of International Application Number PCT/JP2005/016195, filed Aug. 30, 2005.

TECHNICAL FIELD

The present invention relates to a polishing apparatus and a polishing method for polishing optical parts, mechanical parts, ceramics, metals, and the like, and more particularly, to a polishing apparatus and a polishing method suitable for polishing an object such as a wafer formed with semiconductor devices into a flat and mirror-surface state.

BACKGROUND ART

In recent years, as semiconductor devices are increasingly more integrated, circuit wires are made thinner, and the dimensions of integrated semiconductor devices are made smaller and smaller. This leads to the need for a process of removing a coating formed on the surface of a wafer to planarize the surface, and as an approach to this planarizing method, the wafer is polished by a chemical mechanical polishing (CMP) apparatus. The chemical mechanical polishing apparatus comprises a polishing member such as polishing cloth, pad and the like; and a holding member such as a top ring, a chuck and the like for holding an object under polish (i.e., an object being polished). The apparatus presses a surface to be polished against the polishing member, and relatively moves them while supplying a polishing assistant such as an abrasive liquid, a chemical liquid, a slurry, pure water or the like, thereby polishing the surface of the object under polish into a flat and mirror-surface state.

In this type of chemical mechanical polishing apparatus, the polishing member mainly has a discoidal or an annular shape, and polishing apparatuses can be classified into a large-diameter polishing member rotation type, a small-diameter polishing member rotation scanning type, and the like depending on the relationship of magnitude between the polishing member and an object under polish. A polishing apparatus classified as the large-diameter polishing member rotation type rotates an object under polish which is held by a top ring with a surface to be polished being oriented downward, i.e., in a face-down arrangement, and presses the object under polish against a turn table provided with a polishing member larger than the object so as to polish the object. The polishing member is generally rotated by the turn table. On the other hand, a polishing apparatus classified as the small-diameter polishing member rotation scanning type rotates an object under polish which is held by a chuck with a surface to be polished being oriented upward, i.e., in a face-up arrangement, and presses a polishing member smaller than the object against the surface to be polished, while rotating and scanning the polishing member, to polish the object.

In either of the foregoing polishing apparatuses, part of the polishing member temporarily or always extends off the object under polish. This extending polishing member causes an excessive polishing pressure to be applied around the edge of the object under polish, resulting in a degraded flatness around the edge of the object under polish. For this reason, the yield rate of semiconductor devices exacerbates in a wafer formed with the semiconductor devices. This is because more semiconductor devices exist toward the outer periphery of the wafer. Therefore, one challenge imposed to the polishing apparatuses is to extend a region of high flatness as close as possible to the edge, such that the polishing apparatuses can sufficiently support edge exclusion defined by semiconductor device manufacturers and the like.

It is known that the aforementioned excessive polishing pressure is produced because part of the polishing member extending off an object under polish and remaining open is abruptly oppressed by a pressure exerted on the object under polish by the motion of the polishing member relative to the object under polish, i.e., a pressing pressure produced when the polishing member and object under polish are moved while they are kept in contact with each other. Such a phenomenon is called "rebound." The rebound also occurs when a polishing member pressed onto an object under polish extends off the object under polish and is released from the pressing pressure.

In addition to the rebound, the small-diameter polishing member rotation scanning type is generally configured to allow the polishing member to swing together with a mechanism for holding the polishing member, so that the polishing member extending off an object under polish causes the polishing member to incline over the entire surface, causing the pressure to further increase on the edge of the object under polish.

For preventing such an excessive polishing pressure from being applied around the edge of an object under polish, large-diameter polishing member rotation type polishing apparatuses generally have a retainer ring to surround the object under polish at the holding member, such as a top ring for holding the object under polish, such that the polishing member around the object under polish is pressed by the retainer ring to prevent the rebound. This is intended to control the influence of the rebound by a pressure with which the polishing member is pressed against the retainer ring. Therefore, the large-diameter polishing member rotation type polishing apparatus is generally operated after a dummy wafer is previously polished on a trial basis to find, from the result, a pressure condition for the retainer ring under which the rebound exerts a smaller influence and a region of high flatness can be extended as close as possible to the edge, and this pressure is set as a retainer ring pressure.

Also, a method of further reducing the influence of the rebound includes controlling a contact pressure in an edge zone of a wafer using a profile control type top ring for a holding member. This profile control type top ring is configured such that a pressure (pressing pressure) with which a wafer is pressed can be set for each of the areas (pressing section) concentrically partitioned on an object under polish. It is therefore possible to control a pressing pressure for a pressing section (associated with an edge area) which serves the edge area of the wafer independently of other areas. When a pressing pressure in the edge area is made lower than those in other areas, it is possible to limit an excessive pressure due to the rebound.

Therefore, in a large-diameter polishing member rotation type polishing apparatus provided with a profile control type top ring, a dummy wafer is previously polished on a trial basis, as is done for finding a pressure condition for the retainer ring, to find, from the result, a pressing pressure condition for an edge area under which the rebound exerts smaller influence, and a region of high flatness can be extended as close as possible to the edge, and this pressing pressure is set as an edge area pressure before the apparatus is operated. It should be noted that since both the retainer ring pressure and edge area pressure affect the flatness of the wafer edge, a pressure condition must be found for both pressures, rather than finding respective pressure conditions independent of each other, in order to find a more preferable pressure condition.

On the other hand, in regard to the small-diameter polishing member rotation scanning type polishing apparatuses, Laid-open Japanese Patent Application No. 2001-244222 (Patent Document 1), Laid-open Japanese Patent Application No. 2002-75935 (Patent Document 2), Laid-open Japanese Patent Application No. 2002-134448 (Patent Document 3), and Laid-open Japanese Patent Application No. 2003-229388 (Patent Document 4) disclose apparatuses, each of which comprises a supporter for supporting a polishing member which extends off an object under polish to prevent the rebound and inclination of the polishing member and can therefore reduce the edge exclusion. The supporters disclosed in Patent Documents 1-4 perform an action corresponding to the retainer ring in the large-diameter polishing member rotation type polishing apparatus. In the small-diameter polishing member rotation scanning type polishing apparatus, the rebound and inclination of the polishing member can be controlled by the height of a supporting surface of the supporter, for example, a relative height from the top surface of a chuck. Therefore, such a polishing apparatus is operated after a dummy wafer is previously polished on a trial basis to find, from the result, a condition for the height of the supporting surface under which the rebound and inclination of the polishing member exert smaller influences, and a region of high flatness is extended closer to the edge of wafer, and this height is set as the height of the supporting surface.

Thus, in the small-diameter polishing member rotation scanning type polishing apparatus, when an object under polish has a varying thickness, the height of the supporting surface must be adjusted in accordance with the thickness of the object under polish in order to extend a region of high flatness as close as possible to the edge, as described in Patent Document 4. However, in the large-diameter polishing member rotation type polishing apparatus, when the retainer ring is used, variations in the thickness of an object under polish hardly cause a problem because a retainer ring pressure can be controlled.

An edge zone of a bare wafer includes a portion which is inferior in flatness and departs from an ideal shape, as compared with the center of the wafer. Such a shape in the edge zone of the wafer is called "wafer edge roll off" (hereinafter simply called the "roll off"). Not only the bare wafer but also an oxide film wafer polished by a CMP apparatus, for example, when STI (Shallow Trench Isolation) is formed to separate devices presents the roll off derived from the roll off of a bare wafer before the CMP-based polishing. The shape of roll off varies from one wafer to another. Even with the same thickness, the roll off differs. Also, even in a single wafer, there are generally variations in the circumferential direction.

In double-side polished 300-mm wafer used for recent semiconductor integrated circuits, a deviation from a flat surface due to the roll off at a position of 1 mm inwardly from the edge of the wafer is not more than approximately 1 μm at most. However, Akira Hukuda, Hirokuni Hiyama, Manabu Tsujimura, Tetsuo Hukuda, "Influence of Wafer Edge Roll-off on Polishing Profile of CMP," 2004 The Japan Society for Precision Engineering, Autumn Academic Lecture Meeting Collected Papers, p. 497-498. (Non-Patent Document 1), which was published by the present inventors and others, clarified that the roll off affects a polishing profile up to approximately 5 mm inwardly from the edge of a wafer. Here, a current edge exclusion is prevalently 3 mm, and will be 2 mm in the near future with certainty, so that it is understood that the influence of the roll off reaches into the edge exclusion.

As described above, the polishing method according to the prior art involves previously polishing a dummy wafer to find, for example, a pressure to be applied to a polishing pad by a retainer ring in a large-diameter polishing member rotation type polishing apparatus, or, for example, the height of a supporting surface of a supporting member in a small-diameter polishing member rotation scanning type polishing apparatus, setting the pressure or height as a retainer ring pressure or the height of the supporting surface, and operating the apparatus. However, in such a polishing method, if the roll off varies from one wafer to another, the polishing profile also varies, resulting in the inability to extend a flat region to the vicinity of the edge. In other words, a problem arises in the inability to sufficiently support a set edge exclusion. Also, when the roll off varies in the circumferential direction, the polishing profile varies in the circumferential direction, leading to a problem of the inability to extend the flat region to the vicinity of the edge.

For representing the shape of roll off, one can define that a roll off quantity (ROQ) is a set of the distances between several points on a surface to be polished of an object under polish and a reference line which passes a reference point and is substantially parallel with the surface to be polished of the object under polish. FIG. 27 schematically illustrates a cross section, which passes the center of a wafer, used as an object under polish, by emphasizing the value of ROQ and changing the aspect ratio. When the radial direction of the wafer is only taken into consideration, the roll off quantity is a set of the distances between several points on a line indicative of a surface to be polished, appearing on the cross section passing the center of wafer, and the reference line, for example, when the reference point is set above the surface to be polished. For example, when the distance from the center of the wafer is designated by r, the roll off quantity at r is ROQ (r), as shown in FIG. 27. While the radial direction alone is taken into consideration in FIG. 27, the roll off quantity also changes in the circumferential direction, so that it is uniquely determined by the position on the surface to be polished, and the roll off quantity can be represented by ROQ (r,θ), when the coordinates of the surface to be polished is taken on polar coordinates (r,θ) which have the origin at the center of the surface to be polished.

In the foregoing description, the reference point is set above the surface to be polished, but the reference point may be set on the surface to be polished or below the surface to be polished. Also, while polar coordinates are employed in the foregoing description, the coordinate system may be orthogonal coordinates. Further, the reference line may be a straight line substantially parallel with the overall surface to be polished, or may be a straight line substantially parallel with part of the surface to be polished, for example, a range of radius r1 to r2 within the surface to be polished (where r1<r2).

Further, when the value of ROQ is measured not only in the radial direction but also in the circumferential direction, a reference plane may be employed instead of the reference line when the surface to be polished is regarded as two-dimensional. In this event, the reference plane may be a plane substantially parallel with the overall surface to be polished, or a plane substantially parallel with part of the surface to be polished. Also, in measuring and using the roll off quantity, the distance between one point on the surface to be polished and the reference line (or reference plane) may be measured and used, instead of a set of the distances between a plurality of points on the surface to be polished and the reference line (or reference plane).

M. Kimura, Y. Saito, H. Daio, K. Yakushiji, A New Method for the Precise Measurement of Water Roll off of Silicon Polished Wafer, Jpn. J. Appl. Phys., Vol. 38 (1999) Pt. 1, No. 1A, p 38-p 39 (Non-Patent Document 2) shows an example in which a straight line substantially parallel with a region of a wafer in a range of 3 mm to 6 mm from the outer edge of the wafer as part of a surface to be polished is chosen to be a reference line, a position at 1 mm from the outer edge of the wafer is set as a point on the surface to be polished, and the distance between the position and the reference line is measured. This value is called ROA (Roll Off Amount).

The inventors have employed a numerical analysis approach and found when ΔROQ, later described, is only changed that under the same polishing conditions, including a pressure acting between a polishing member and a wafer, a pressure acting between the polishing member and a retainer ring, and the like, a maximum polishing rate and a minimum polishing rate change inside the edge exclusion as ΔROQ is different. Assume hereinafter that the maximum polishing rate and minimum polishing rate indicate values inside the edge exclusion unless otherwise noted. Here, ΔROQ means a value calculated by ΔROQ=ROQ1−ROQ0, where ROQ0 is the roll off quantity at the center of a wafer, and ROQ1 is the roll off quantity at a location 1 mm from the wafer edge, for example, on a surface to be polished of a wafer. The value of ROQ1 may be an average of ROQ's at respective points in the circumferential direction of the wafer W or the value only at a single point used as a representative value. It has been recognized, on the other hand, that polishing can be carried out with a practically sufficient flatness as long as the maximum polishing rate and minimum polishing rate fall within an appropriate range.

Conventionally, when the roll off varies among wafers, the polishing profile also varies, occasionally resulting in a situation in which the flatness exacerbates, but it has been revealed from the foregoing finding that this is caused by variations in roll off which force the maximum polishing rate or minimum polishing rate or both to extend off an appropriate range. For reference, the polishing rate means the rate at which a surface to be polished is polished, and generally indicated by the velocity. For example, its dimension can be represented by [length]/[time]. In the present invention, this dimension is further divided by pressure to derive the rate per unit pressure which is used as the polishing rate. Also, in this specification, the polishing profile refers to the shape of a distribution of the polishing rate within the wafer surface.

The inventors diligently investigated, using numerical analyses, a means which can control the polishing rate to an appropriate value to find a preferred polishing profile, and reached to attain the following findings. As a first finding, it was found that when wafers having the same ΔROQ were polished while the retainer ring pressure alone was changed under the same polishing conditions including the pressure between the polishing member and wafer and the like, the maximum polishing rate and minimum polishing rate changed in accordance with the retainer ring pressure (see FIG. 3 in regard to this finding). Drawing inspiration from this fact, the inventors found that the object under polish can be polished with a practically sufficient flatness by adjusting the retainer ring pressure in accordance with ΔROQ of a wafer such that the maximum polishing rate and minimum polishing rate fall within an appropriately set range.

A second finding is that when a numerical analysis was made on wafers having the same ΔROQ while the height of the supporting surface alone was changed with the rest of polishing conditions remaining the same, the maximum polishing rate and minimum polishing rate also changed in this case. Drawing inspiration from this fact, the inventors ended up to think that the object under polish can also be polished with a practically sufficient flatness by adjusting the height of the supporting surface in accordance with ΔROQ of the wafer such that the maximum polishing rate and minimum polishing rate fall within an appropriately set range (see FIG. 8 in regard to this finding).

As a third finding, in a large-diameter polishing member rotation type polishing member provided with a profile control type top ring as a holding member, it was found that when a numerical analysis was made on wafers having the same ΔROQ while the pressing pressure alone was changed for an edge area with the rest of polishing conditions remaining the same, the maximum polishing rate and minimum polishing rate also changed in this case. Drawing inspiration from this fact, the inventors ended up to think that the object under polish can also be polished with a practically sufficient flatness by adjusting the pressing pressure for the edge area in accordance with ΔROQ of the wafer such that the maximum polishing rate and minimum polishing rate fall within an appropriately set range.

As a fourth finding, in a large-diameter polishing member rotation type polishing member provided with a profile control type top ring, the inventors ended up to think that the object under polish can also be polished with a practically sufficient flatness by adjusting both the pressing pressure for the edge area and the retainer ring pressure in accordance with ΔROQ of the wafer such that the maximum polishing rate and minimum polishing rate fall within an appropriately set range. Also, when a numerical analysis was made while changing the modulus of elasticity and the thickness of a polishing member, it was found that the influence of the retainer ring pressure and the pressing pressure for the edge area on the polishing rate changes depending on the modulus of elasticity and the thickness of the polishing member. As a result of diligently studying from the foregoing, it was found that there are respective ranges for the modulus of elasticity and for the thickness of the polishing member suitable for polishing a wafer with a practically sufficient flatness by adjusting the retainer pressure and the pressing pressure for the edge area in accordance with the roll off of the wafer.

The present invention has been made in view of the foregoing challenge and findings, and it is an object of the invention to provide a polishing apparatus and a polishing method which are capable of polishing an object under polish with a high yield rate even if the object under polish presents a roll off. Further, it is an object of the present invention to provide a semiconductor device manufacturing method which is capable of manufacturing semiconductor devices at a low cost, and to provide low-cost semiconductor devices.

DISCLOSURE OF THE INVENTION

In view of the foregoing findings, and to achieve the above objects, a first aspect of the invention provides a polishing apparatus including a polishing section having a polishing member and a holding member, for applying a pressure between the polishing member and an object under polish held by the holding member, while moving the polishing member to the object under polish, relative to polish the object under polish. The polishing apparatus is characterized by comprising:

a supporting member having a supporting surface, operative when the polishing member extends off the object under polish during polishing of the object under polish, for supporting at least part of a portion of the polishing member which extends off;

a pressure adjusting mechanism for adjusting a supporting pressure on the supporting surface of the supporting member; and a control unit for controlling the pressure adjusting mechanism to bring the supporting pressure to a desired pressure with reference to information based on a roll off quantity of the object under polish.

It should be noted the information based on the roll off quantity includes the roll off quantity itself, positional information on each member of the polishing apparatus, the roll off quantity and/or information derived by processing the roll off quantity, and a supporting pressure (retainer ring pressure) calculated or selected using them.

A second aspect of the invention is characterized by further comprising a measuring unit for measuring the information based on the roll off quantity.

A third aspect of the invention is characterized in that the entirety of the supporting surface has the same level. Preferably, the supporting surface is strictly at the same level. However, an actual polishing apparatus involves, for example, a surface roughness when the supporting surface is processed, a backlash of the pressure adjusting mechanism, and the like, so that strictly the same level is difficult to achieve, but the level may be uniform to such a degree that it can be regarded as substantially the same.

A fourth aspect of the invention is characterized in that the supporting member comprises a plurality of supporting elements arranged along the periphery of the object under polish, wherein each of the supporting elements can be moved between a first position on a plane parallel with the surface to be polished of the object under polish and along the periphery of the object under polish, and a second position radially spaced further away from the center of the object under polish than the first position.

A fifth aspect of the invention is characterized in that the first position is a position substantially without a gap between the peripheral edge of the object under polish and the supporting surface of the supporting element.

A sixth aspect of the invention is characterized by comprising a plurality of the polishing sections, wherein the control unit independently operates the pressure adjusting mechanism provided in each of the polishing sections such that the supporting pressure in each of the polishing sections is independently brought to a desired pressure.

A seventh aspect of the invention provides a polishing apparatus including a polishing section having a polishing member and a holding member, for applying a pressure between the polishing member and an object under polish held by the holding member, while moving the polishing member relative to the object under polish, to polish the object under polish. The polishing apparatus is characterized by comprising:

a supporting member having a supporting surface, operative when the polishing member extends off the object under polish during polishing of the object under polish, for supporting at least part of a portion of the polishing member which extends off;

a height adjusting mechanism for adjusting a height of the supporting surface of the supporting member; and a control unit for controlling the height adjusting mechanism to bring the height of the supporting surface to a desired height with reference to information based on a roll off quantity of the object under polish.

It should be noted the information based on the roll off quantity includes the roll off quantity itself, positional information on each member of the polishing apparatus, the roll off quantity and/or information derived by processing the roll off quantity, and a the height of the supporting surface calculated or selected using them.

An eighth aspect of the invention is characterized by comprising a measuring unit for acquiring information based on the roll off quantity.

A ninth aspect of the invention is characterized in that the entirety of the supporting surface has the same level. Preferably, the supporting surface is strictly at the same level. However, an actual polishing apparatus involves, for example, a surface roughness when the supporting surface is processed, a backlash of the pressure adjusting mechanism, and the like, so that strictly the same level is difficult to achieve, but the level may be uniform to such a degree that it can be regarded as substantially the same.

A tenth aspect of the invention is characterized in that the supporting member comprises a plurality of supporting elements arranged along the periphery of the object under polish, wherein each of the supporting elements can be moved between a first position on a plane parallel with the surface to be polished of the object under polish and along the periphery of the object under polish, and a second position radially spaced further away from the center of the object under polish than the first position.

An eleventh aspect of the invention is characterized in that the first position is a position substantially without a gap between the peripheral edge of the object under polish and the supporting surface of the supporting element.

A twelfth aspect of the invention is characterized by comprising a plurality of the polishing sections, wherein the control unit independently operates the height adjusting mechanism provided in each of the polishing sections such that the height of the supporting surface in each of the polishing sections is independently brought to a desired height.

A thirteenth aspect of the invention provides a polishing method for polishing an object under polish by applying a pressure between a polishing member and the object under polish held by a holding member, while moving the polishing member relative to the object under polish, and supporting at least part of a portion of the polishing member which extends off the object under polish, when the portion extends off, during the polishing. The method is characterized by comprising the steps of:

acquiring information indicative of a roll off quantity of the object under polish;

calculating a desired value for a supporting pressure for supporting the extending portion based on information including the information; and adjusting the supporting pressure based on the calculated desired value.

A fourteenth aspect of the invention provides a program for causing a computer to execute a polishing method for polishing an object under polish by applying a pressure between a polishing member and the object under polish held by a holding member, while moving the polishing member relative to the object under polish, and supporting at least part of a portion of the polishing member which extends off the object under polish, when the portion extends off, during the polishing. The program is characterized by comprising:

an instruction for acquiring information indicative of a roll off quantity of the object under polish;

an instruction for calculating a desired value for a supporting pressure for supporting the extending portion based on information including the information; and an instruction for adjusting the supporting pressure based on the calculated desired value.

A fifteenth aspect of the invention relate to a computer readable storage medium characterized by storing the program of the invention according to the fourteenth aspect described above.

A sixteenth aspect of the invention relates to a polishing apparatus characterized by comprising a device for reading the program stored in the storage medium of the invention according to the fifteenth aspect described above, wherein the control unit operates the pressure adjusting mechanism in accordance with the program read from the storage medium.

A seventeenth aspect of the invention provides a polishing method for polishing an object under polish by applying a pressure between a polishing member and the object under polish held by a holding member, while relatively moving the polishing member to the object under polish, and supporting at least part of a portion of the polishing member which extends off the object under polish, when the portion extends off, during the polishing. The method is characterized by comprising the steps of:

acquiring information indicative of a roll off quantity of the object under polish;

calculating a desired value for a height of a supporting surface for supporting the extending portion based on information including the information; and adjusting the height of the supporting surface based on the calculated desired value.

An eighteenth aspect of the invention provides a computer program for causing a computer to execute a polishing method for polishing an object under polish by applying a pressure between a polishing member and the object under polish held by a holding member, while moving the polishing member relative to the object under polish, and supporting at least part of a portion of the polishing member which extends off the object under polish, when the portion extends off, during the polishing. The program is characterized by comprising:

an instruction for acquiring information indicative of a roll off quantity of the object under polish;

an instruction for calculating a desired value for a height of a supporting surface for supporting the extending portion based on information including the information; and an instruction for adjusting the height of the supporting surface based on the calculated desired value.

A nineteenth aspect of the invention relates to a computer readable storage medium characterized by storing the program of the invention according to the eighteenth aspect described above.

A twentieth aspect of the invention relates to a polishing apparatus characterized by comprising a device for reading the program stored in the storage medium of the invention according to the nineteenth aspect described above, wherein the control unit operates the height adjusting mechanism in accordance with the program read from the storage medium.

A twenty-first aspect of the invention provides a polishing apparatus including a polishing section having a holding member having at least two pressing sections, each of which can apply an arbitrary pressure to an object under polish, and a polishing member, for applying a pressure between the polishing member and an object under polish held by the holding member, while moving the polishing member relative to the object under polish, to polish the object under polish. The polishing apparatus is characterized by comprising:

a pressure adjusting mechanism for adjusting a pressing pressure of the pressing section associated with the outermost area of the object under polish among the pressing sections of the holding member; and a control unit for controlling the pressure adjusting mechanism to bring the pressing pressure to a desired pressure with reference to information based on a roll off quantity of the object under polish.

A twenty-second aspect of the invention is characterized by comprising a measuring unit for acquiring information based on the roll off quantity.

A twenty-third aspect of the invention provides a method of polishing an object under polish held by a holding member having at least two pressing sections, each of which can apply an arbitrary pressure to the object under polish by applying a pressure between the object under polish and a polishing member while moving the polishing member relative to the object under polish. The polishing method is characterized by comprising the steps of:

acquiring information indicative of a roll off quantity of the object under polish;

calculating a desired value for a pressing pressure of a pressing section associated with the outermost area of the object under polish among the pressing sections of the holding member based on information including the information; and adjusting the pressing pressure based on the calculated desired value.

The twenty-fourth aspect of the invention provides a program for causing a computer to execute a method of polishing an object under polish held by a holding member having at least two pressing sections, each of which can apply an arbitrary pressure to the object under polish by applying a pressure between the object under polish and a polishing member while moving the polishing member relative to the object under polish. The program is characterized by comprising:

an instruction for acquiring information indicative of a roll off quantity of the object under polish;

an instruction for calculating a desired value for a pressing pressure of a pressing section associated with the outermost area of the object under polish among the pressing sections of the holding member based on information including the information; and an instruction for adjusting the pressing pressure based on the calculated desired value.

A twenty-fifth aspect of the invention provides a computer readable storage medium characterized by storing the program of the invention according to the twenty-fourth aspect described above.

A twenty-sixth aspect of the invention provides a polishing apparatus characterized by comprising a device for reading the program stored in the storage medium of the invention according to the twenty-fifth aspect described above, wherein the control unit operates the pressure adjusting mechanism in accordance with the program read from the storage medium.

A twenty-seventh aspect of the invention provides a polishing apparatus including a polishing section having a polishing member, a supporting member, and a holding member including at least two pressing sections, for polishing an object under polish held by the holding member by applying a pressure between the polishing member and the object under polish while moving the polishing member relative to the object under polish. The polishing apparatus is characterized by comprising:

a pressure adjusting mechanism for adjusting a pressing pressure of a pressing section associated with the outermost area of the object under polish among the pressing sections of the holding member;

a pressure adjusting mechanism for adjusting a supporting pressure on a supporting surface of the supporting member; and a control unit for controlling the pressure adjusting mechanism to bring the pressing pressure and the supporting pressure to respective desired pressures with reference to information based on a roll off quantity of the object under polish.

A twenty-eighth aspect of the invention is characterized by comprising a measuring unit for acquiring the information based on the roll off quantity.

A twenty-ninth aspect of the invention provides a polishing method in a polishing apparatus comprising a polishing member, a supporting member, and a holding member including at least two pressing sections for polishing an object under polish held by the holding member by applying a pressure between the polishing member and the object under polish while moving the polishing member relative to the object under pressure. The method is characterized by comprising the steps of:

acquiring information indicative of a roll off quantity of the object under polish;

calculating a desired value for a supporting pressure on a supporting surface of the supporting member based on information including the information;

calculating a desired value for a pressing pressure of a pressing section associated with the outer most region of the object under polish among the pressing sections of the holding member based on the information including the information; and adjusting the supporting pressure and the pressing pressure based on the calculated desired values.

A thirtieth aspect of the invention provides a program for causing a computer to execute a polishing method in a polishing apparatus comprising a polishing member, a supporting member, and a holding member including at least two pressing sections for polishing an object under polish held by the holding member by applying a pressure between the polishing member and the object under polish while moving the polishing member relative to the object under pressure. The program is characterized by comprising:

an instruction for acquiring information indicative of a roll off quantity of the object under polish;

an instruction for calculating a desired value for a supporting pressure on a supporting surface of the supporting member based on information including the information;

an instruction for calculating a desired value for a pressing pressure of a pressing section associated with the outer most region of the object under polish among the pressing sections of the holding member based on the information including the information; and an instruction for adjusting the supporting pressure and the pressing pressure based on the calculated desired values.

A thirty-first aspect of the invention provides a computer readable storage medium characterized by storing the program of the invention according to the thirtieth aspect of the invention described above.

A thirty-second aspect of the invention provides a polishing apparatus characterized by comprising a device for reading the program stored in the storage medium of the invention according to the thirty-first aspect of the invention described above, wherein the control unit operates the pressure adjusting mechanisms in accordance with the program read from the storage medium.

A thirty-third aspect of the invention provides a single-layer polishing member having a modulus of elasticity represented by X [MPa] and a thickness represented by Y [mm], characterized in that X and Y fall under a range which satisfies:

$$0.9 \leqq 0.88+0.0336Y+0.000259X-0.0063Y^2-0.000021X^2+0.0004XY, \text{ and} \quad \text{Equation 1}$$

$$1.1 \geqq 1.19-0.153Y+0.0022X+0.025Y^2+0.000032X^2-0.00041XY. \quad \text{Equation 2}$$

A thirty-fourth aspect of the invention provides a single-layer polishing member having a modulus of elasticity represented by X [MPa] and a thickness represented by Y [mm], characterized in that X and Y fall under a range which satisfies:

$$0.94 \leqq 0.88+0.0336Y+0.000259X-0.0063Y^2-0.000021X^2+0.0004XY, \quad \text{Equation 3}$$

$$1.06 \geqq 1.19-0.153Y+0.0022X+0.025Y^2+0.000032X^2-0.00041XY. \quad \text{Equation 4}$$

A thirty-fifth aspect of the invention provides a two-layer polishing member comprising a layer placed in contact with an object under polish, and having a modulus of elasticity represented by Xu [MPa] and a thickness represented by Yu [mm], and the other layer having the modulus of elasticity represented by Xd [MPa], characterized in that Xu, Yu, Xd fall within a range which satisfies:

$$0.9 \leqq 0.763-0.0031Xu+0.0281Xd+0.0323Yu+0.000018Xu^2-0.0008Xd^2-0.0017Yu^2+0.00011XuXd+0.000097XuYu-0.0017XdYu, \text{ and} \quad \text{Equation 5}$$

$$0.9 \leqq 0.877+0.0023Xu+0.055Yu+0.0000055Xu^2+0.00032Xd2-0.0052Yu^2-0.000099XuXd+0.00072XuYu-0.00137XdYu \leqq 1.1. \quad \text{Equation 6}$$

A thirty-sixth aspect of the invention provides a two-layer polishing layer comprising a layer placed in contact with an object under polish, and having a modulus of elasticity represented by Xu [MPa] and a thickness represented by Yu [mm], and the other layer having the modulus of elasticity represented by Xd [MPa], characterized in that Xu, Yu, Xd fall within a range which satisfies:

$$0.94 \leqq 0.763-0.0031Xu+0.0281Xd+0.0323Yu+0.000018Xu^2-0.0008Xd^2-0.0017Yu^2+0.00011XuXd+0.000097XuYu-0.0017XdYu, \text{ and} \quad \text{Equation 7}$$

$$0.94 \leqq 0.877+0.0023Xu+0.055Yu+0.0000055Xu^2+0.00032Xd^2-0.0052Yu^2-0.000099XuXd+0.00072XuYu-0.00137XdYu \leqq 1.06. \quad \text{Equation 8}$$

A thirty-seventh aspect of the invention provides a polishing apparatus including a polishing section having a polishing member and a holding member, for applying a pressure between the polishing member and an object under polish held by the holding member, while moving the polishing member relative to the object under polish, to polish the object under polish. The polishing apparatus is characterized in that:

the polishing member comprises the polishing member of the invention according to any of the thirty-third to thirty-sixth aspects of the invention described above.

A thirty-eighth aspect of the invention provides a polishing apparatus of the invention according to any of the first to twelfth, sixteenth, twentieth, twenty-first, twenty-second, twenty-sixth, twenty-seventh, twenty-eighth, and thirty-second aspects of the invention characterized in that the polishing member comprises the polishing member according to any of the thirty-third to thirty-sixth aspect of the invention described above.

The invention of claim 39 relates to a semiconductor device manufacturing method characterized by comprising a process of planarizing a surface of a wafer using the polishing apparatus of the invention according to any of claims 1 to 12, 16, 20, 21, 22, 26, 27, 28, 32, 37 and 38.

The invention of claim 40 relates to a semiconductor device manufacturing method characterized by comprising a process of planarizing a surface of a wafer using the polishing method of the invention according to claims 13, 17, 23 and 29.

The invention of claim 41 relates to a semiconductor device characterized by being manufactured by the semiconductor device manufacturing method of the invention according to claim 39 or 41.

In each of the foregoing inventions of claims 1 to 41, the size of the polishing member may be the same as the size of the object under polish, or the polishing member may be larger than the object under polish, or the polishing member may be smaller than the object under polish. Also, the supporting member may be fixed or may not be fixed to the holding member. Further, the information based on the roll off quantity includes the roll off quantity (for example, ROQ (r,θ)), an electric signal or a numerical value derived by measuring the roll off quantity, information derived by processing them, and the height/supporting pressure of the supporting surface calculated or selected using them. It should be noted that the height/supporting pressure of the supporting surface can be calculated using positional information on a variety of members of the polishing apparatus and roll off measuring device, in addition to the roll off quantity.

BRIEF DESCRIPTION OF THE INVENTION

Figure 9:
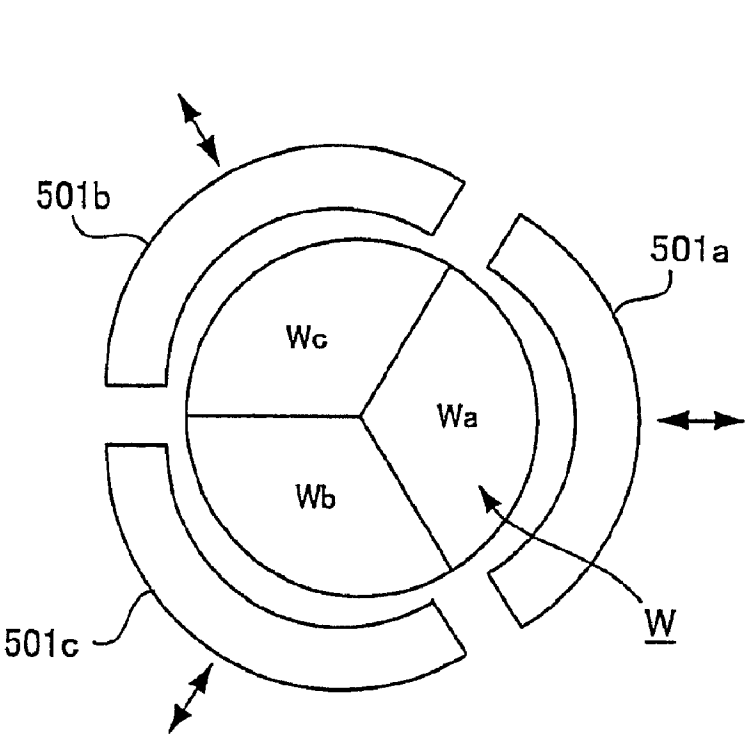
Figure 9:
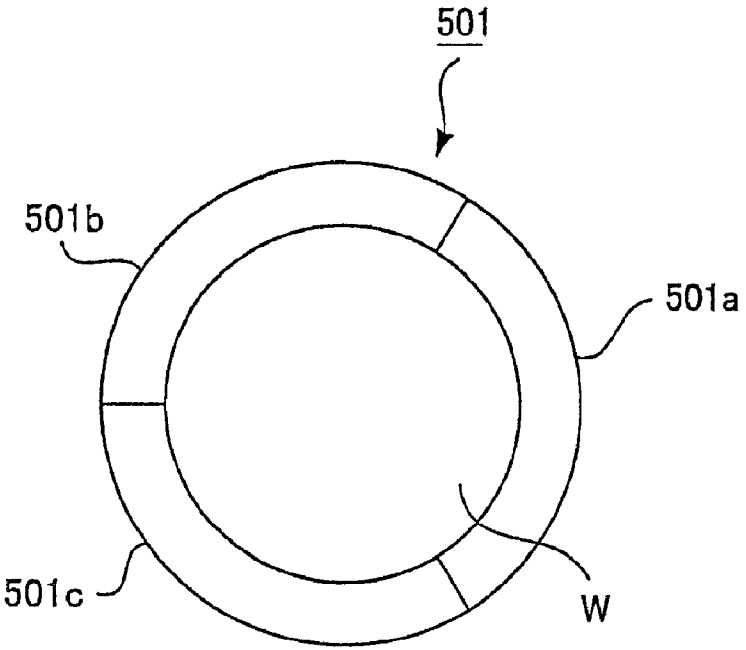
Figure 10:
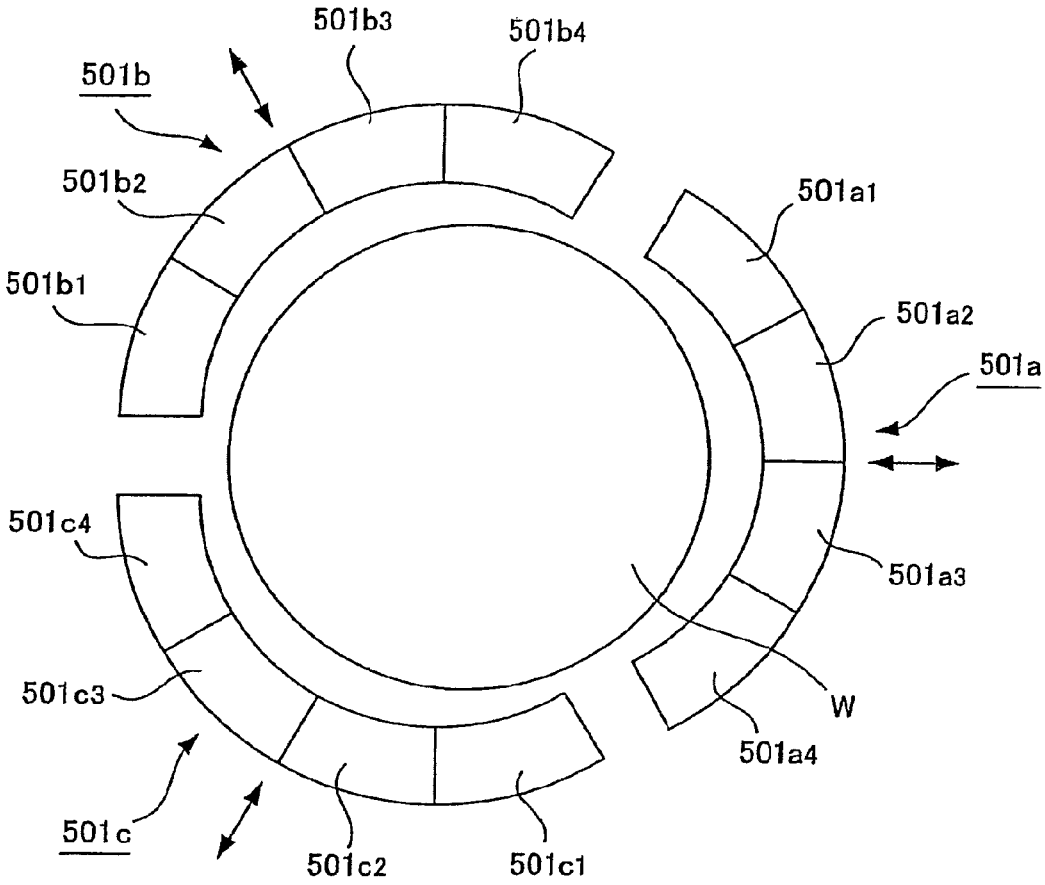
Figure 11:
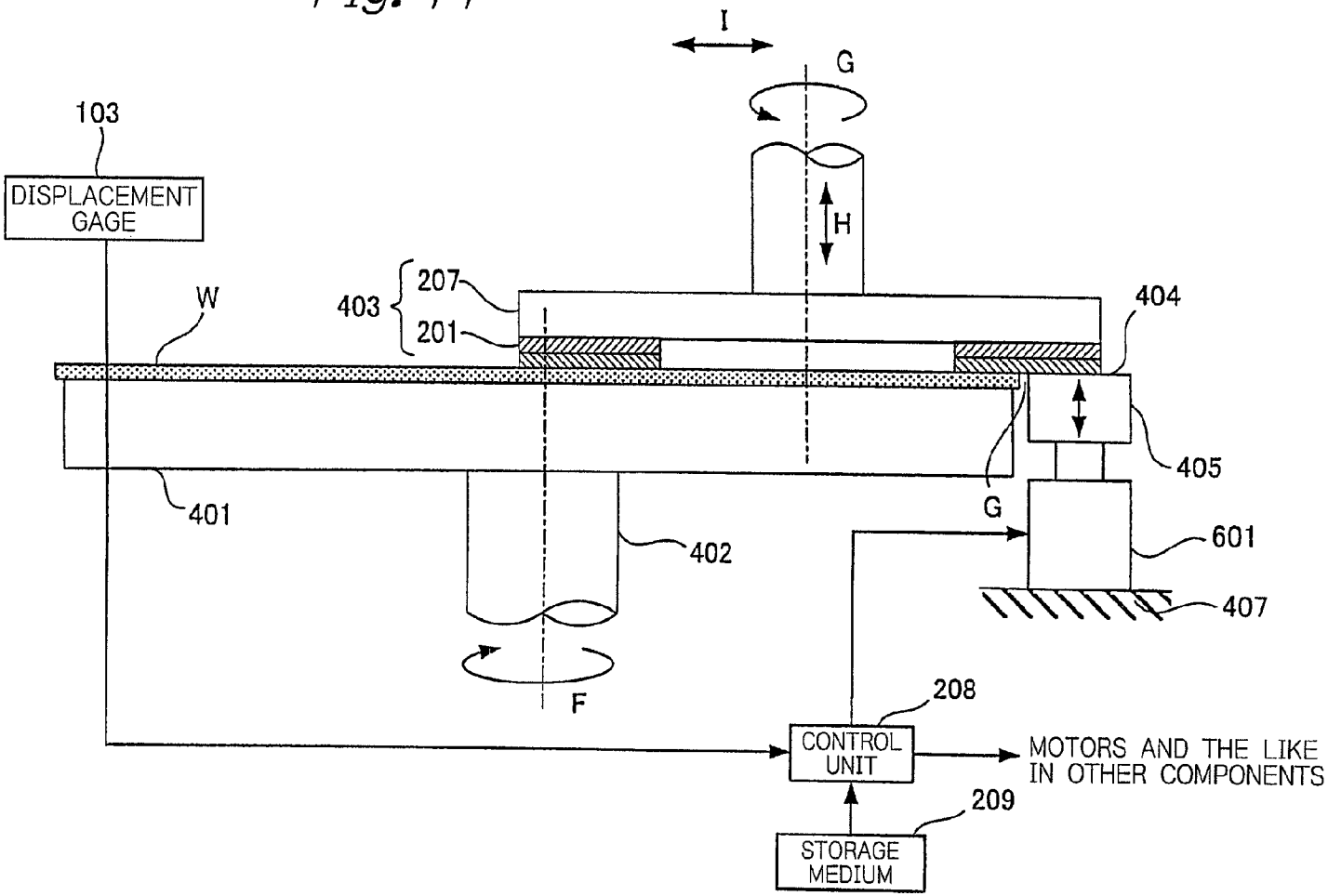
Figure 12:
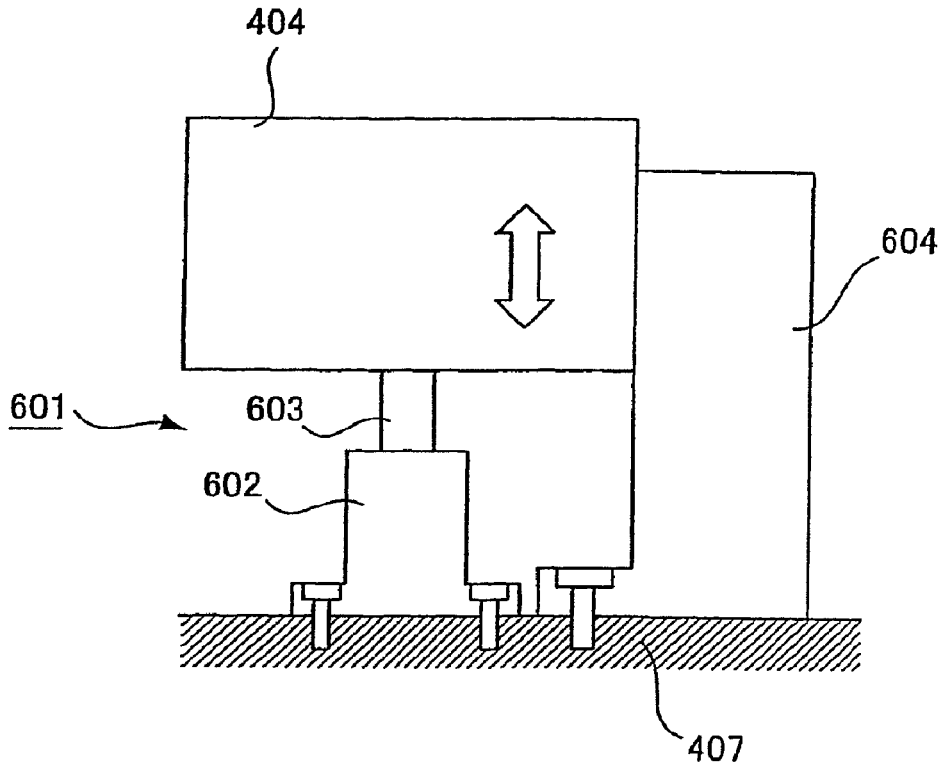
Figure 13:
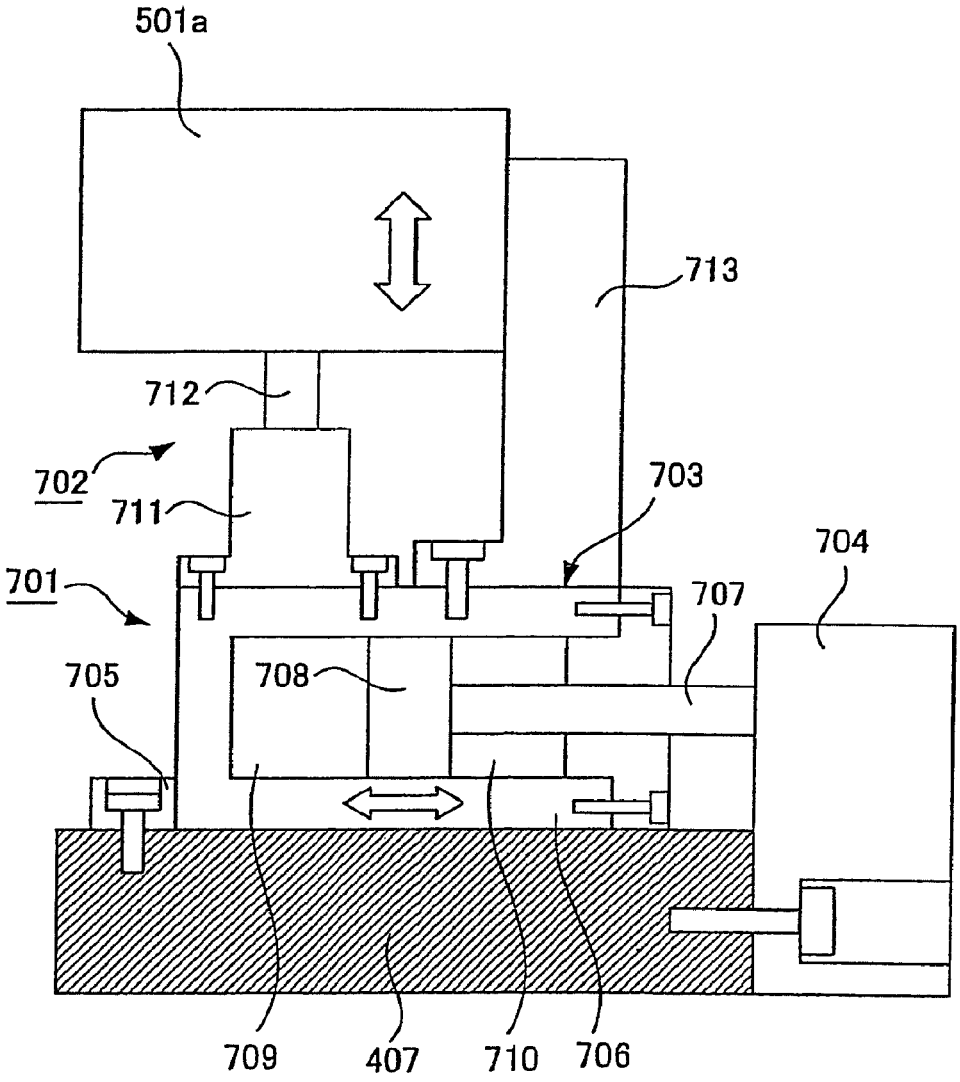
Figure 14:
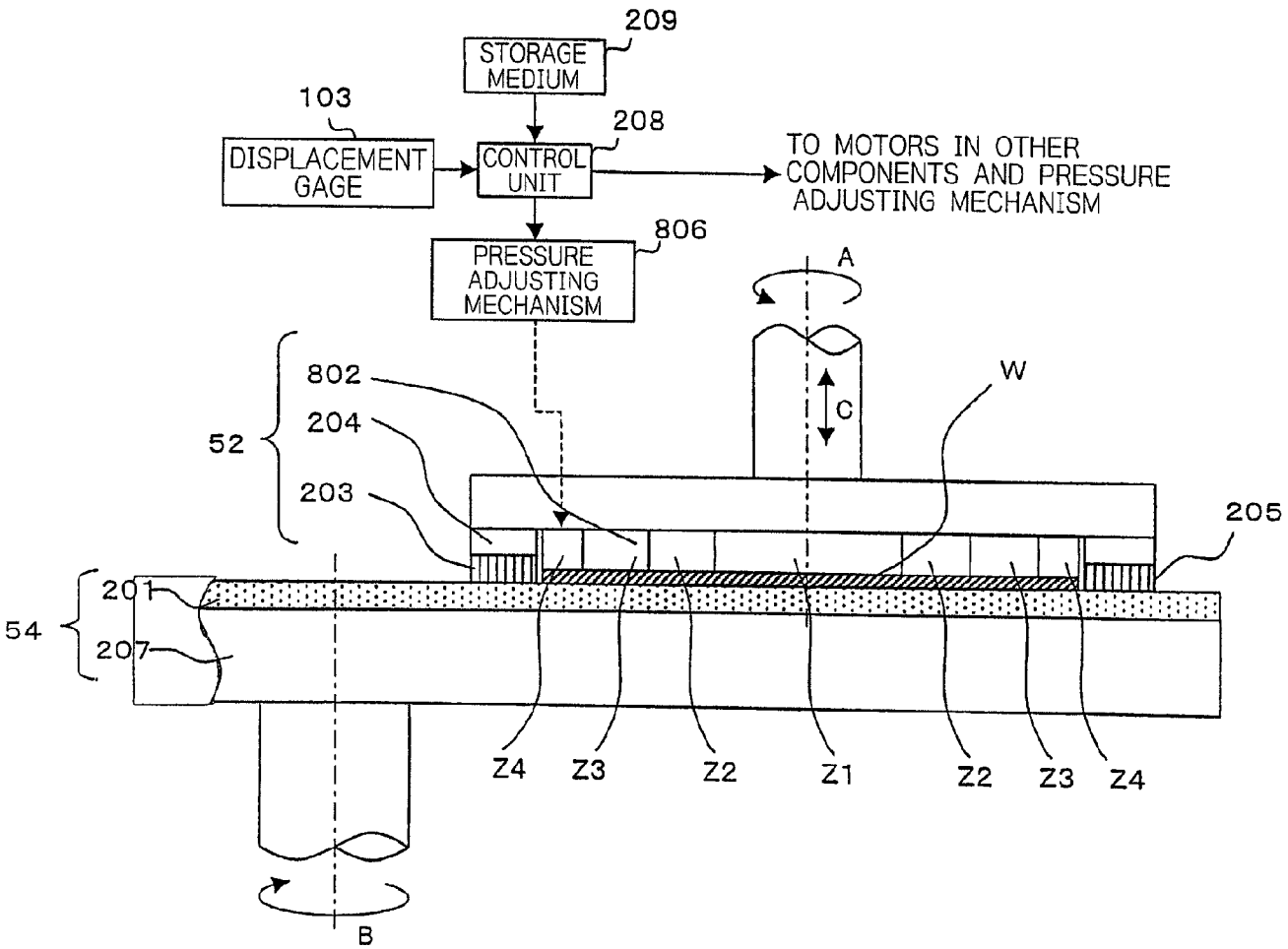
Figure 15:
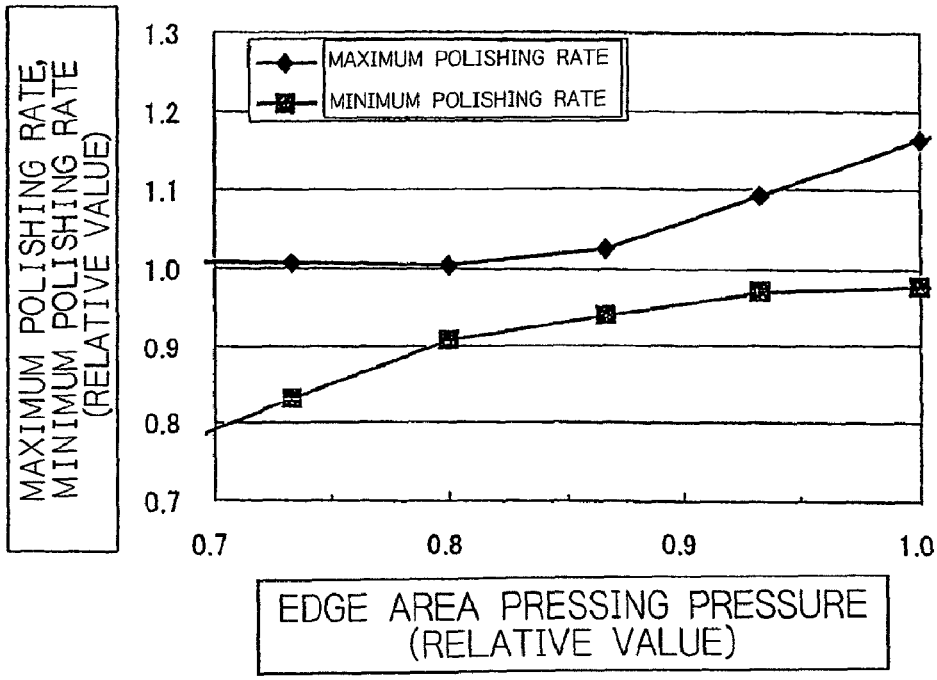
Figure 16:
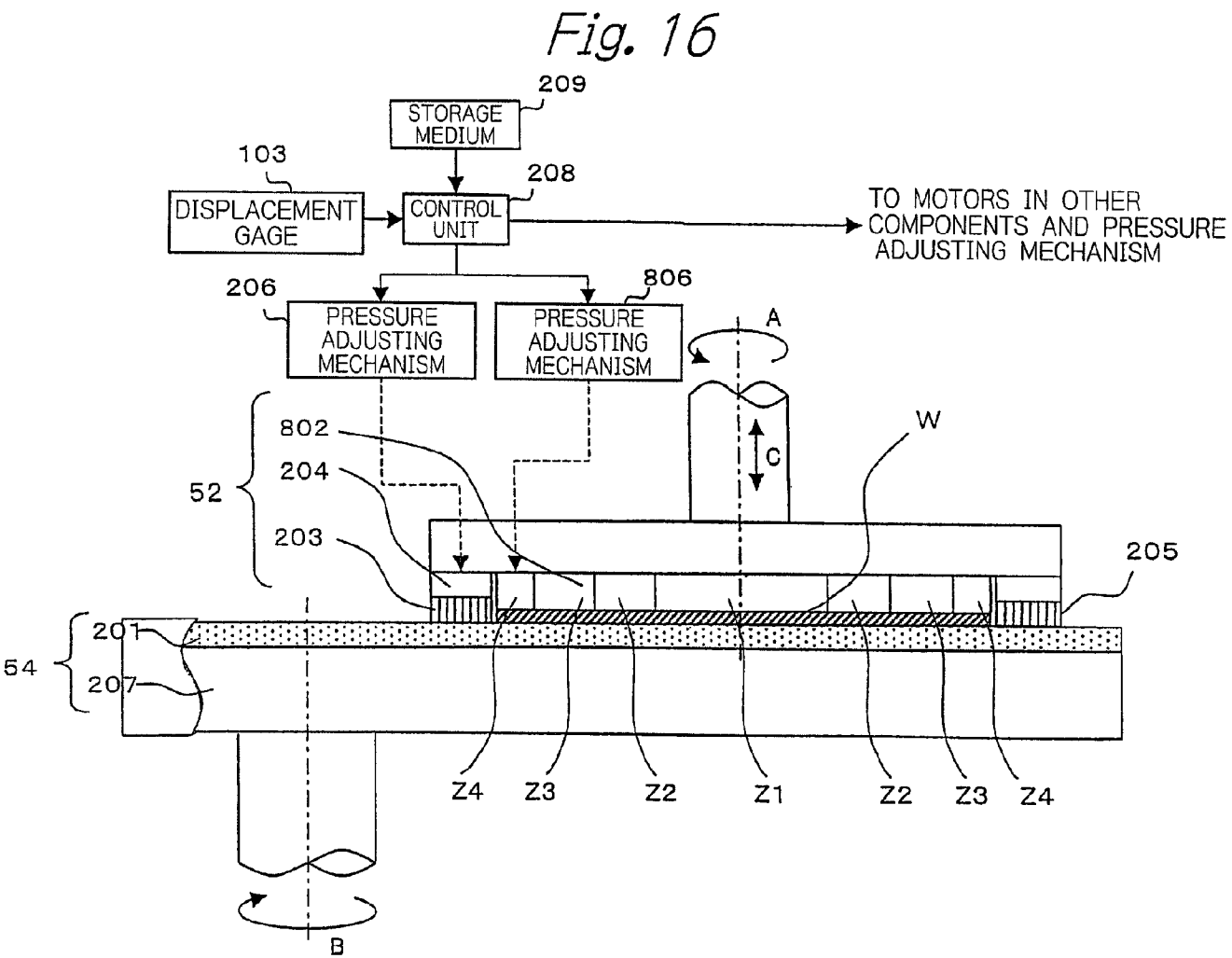
Figure 17:
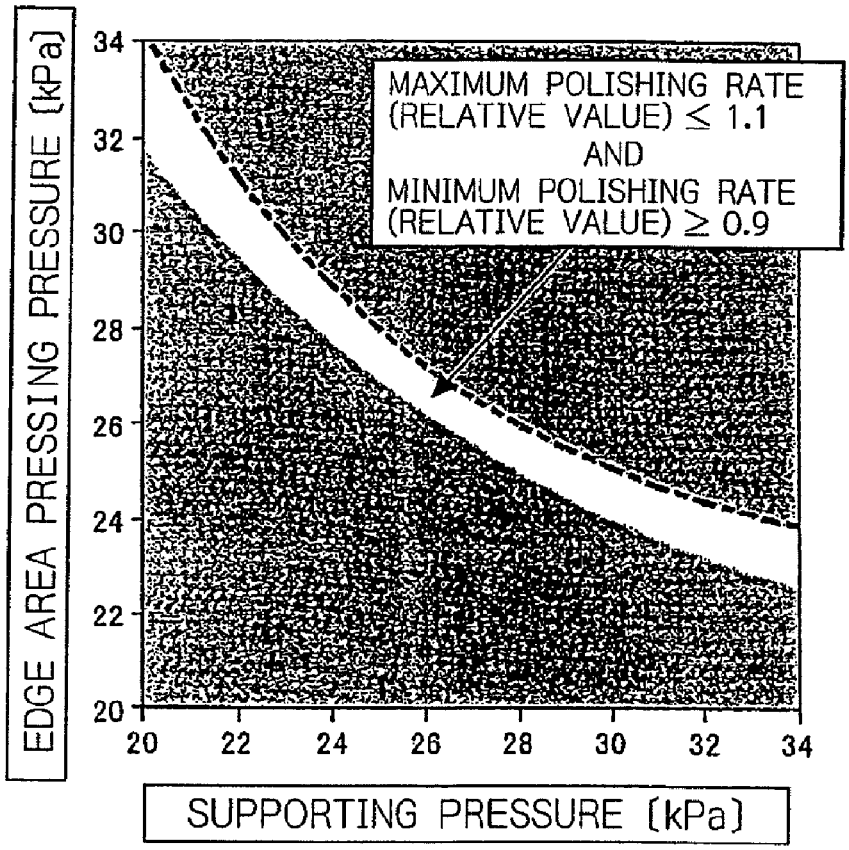
Figure 18:
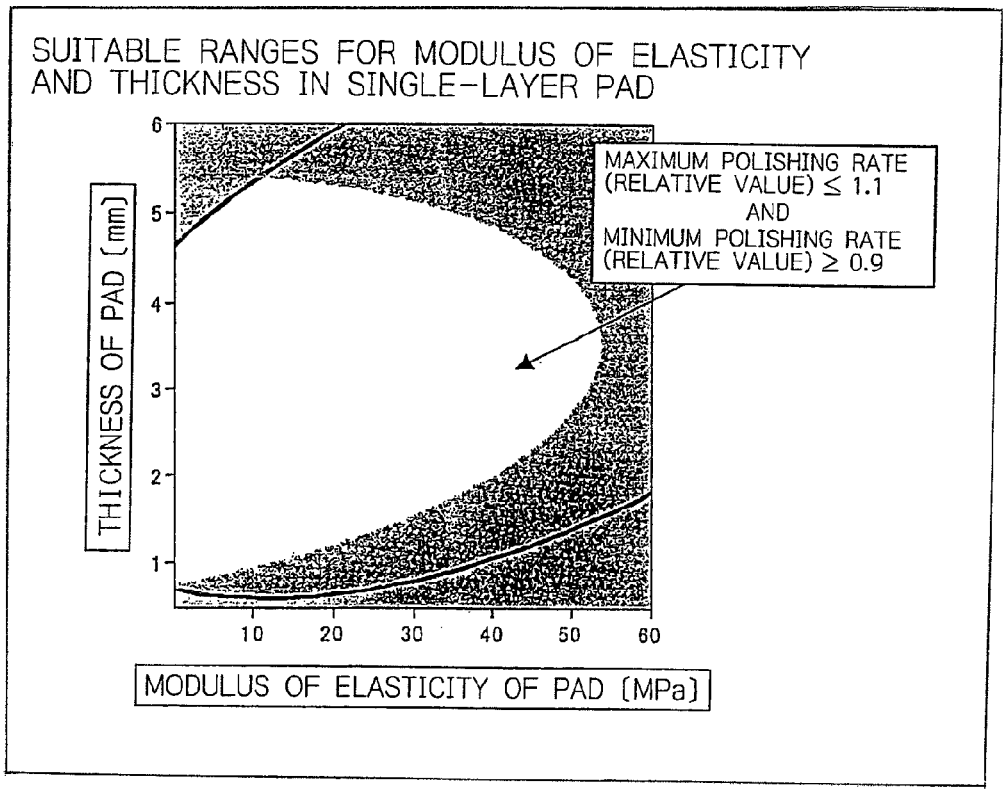
Figure 19:
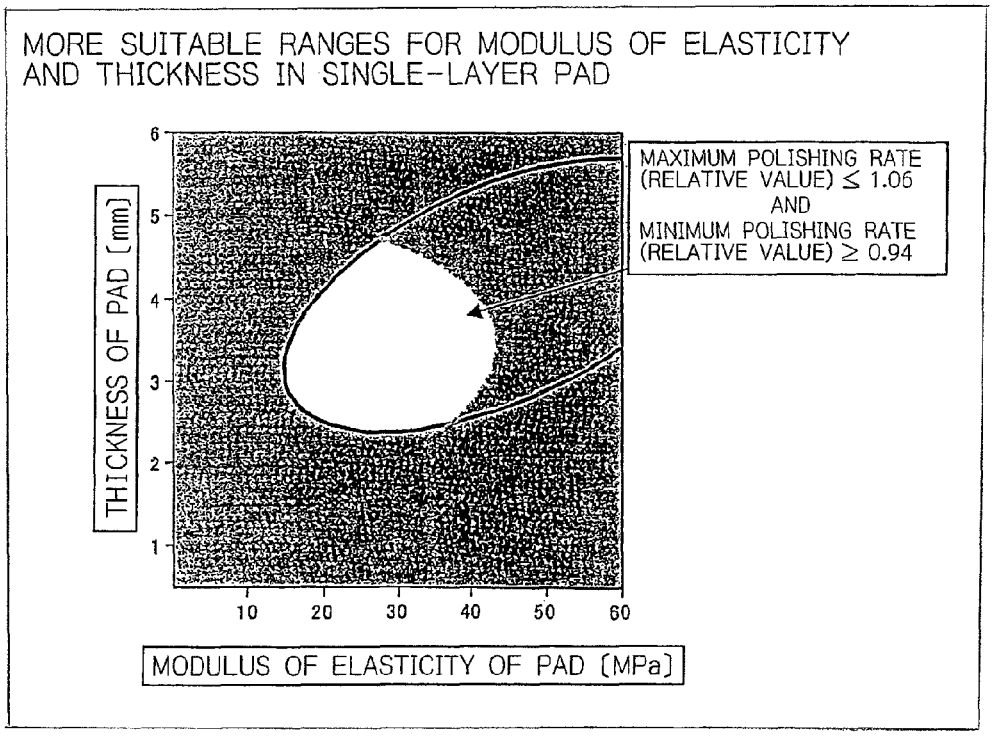
Figure 21:
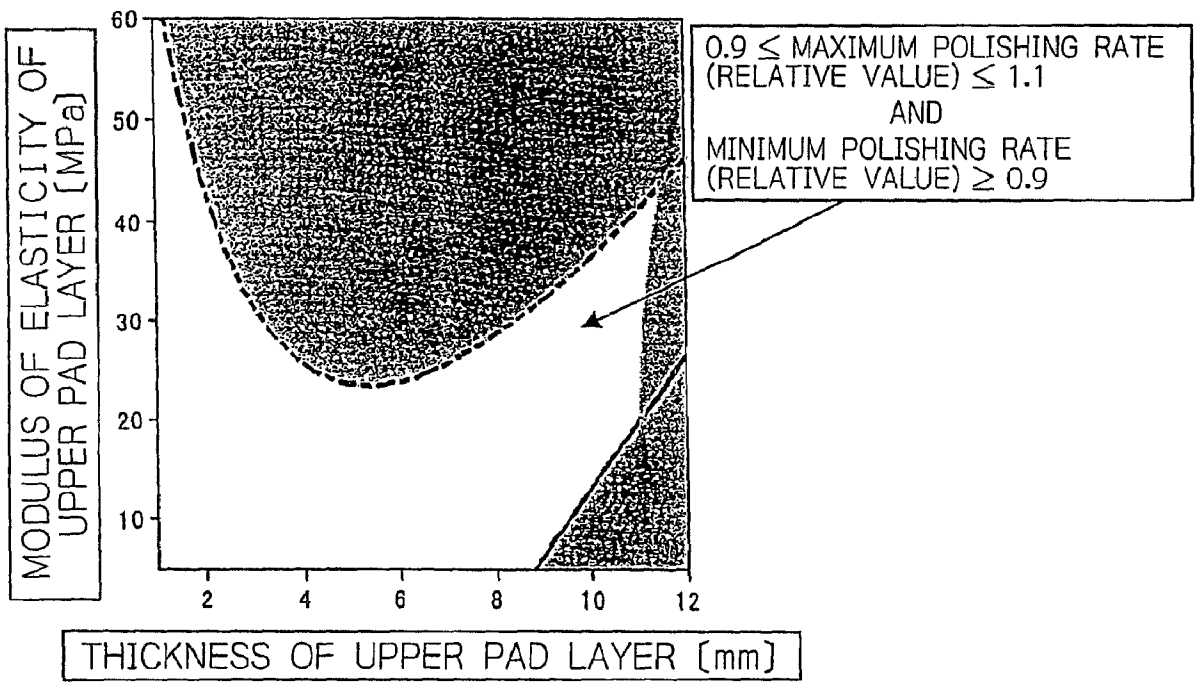
Figure 22:
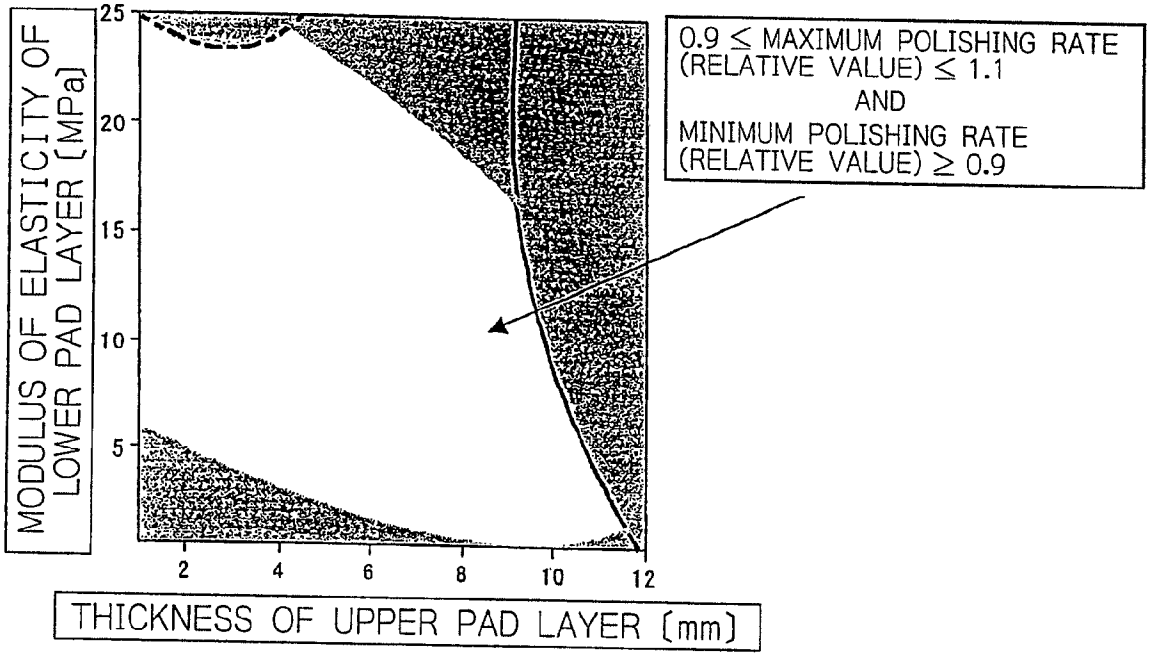
Figure 23:
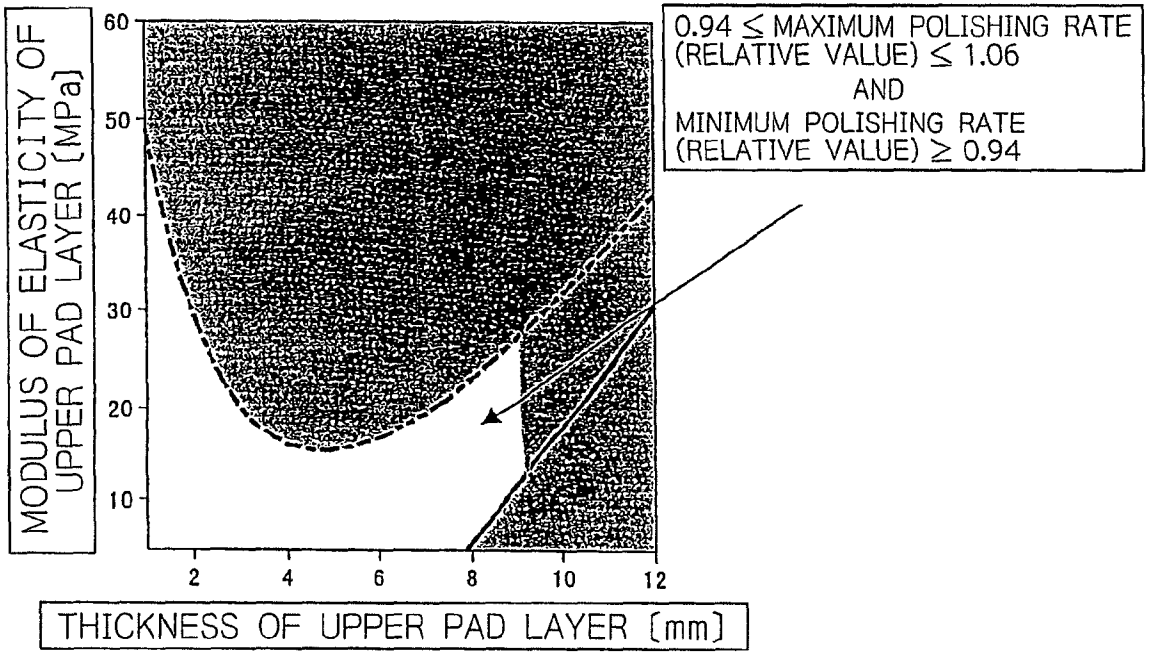
Figure 24:
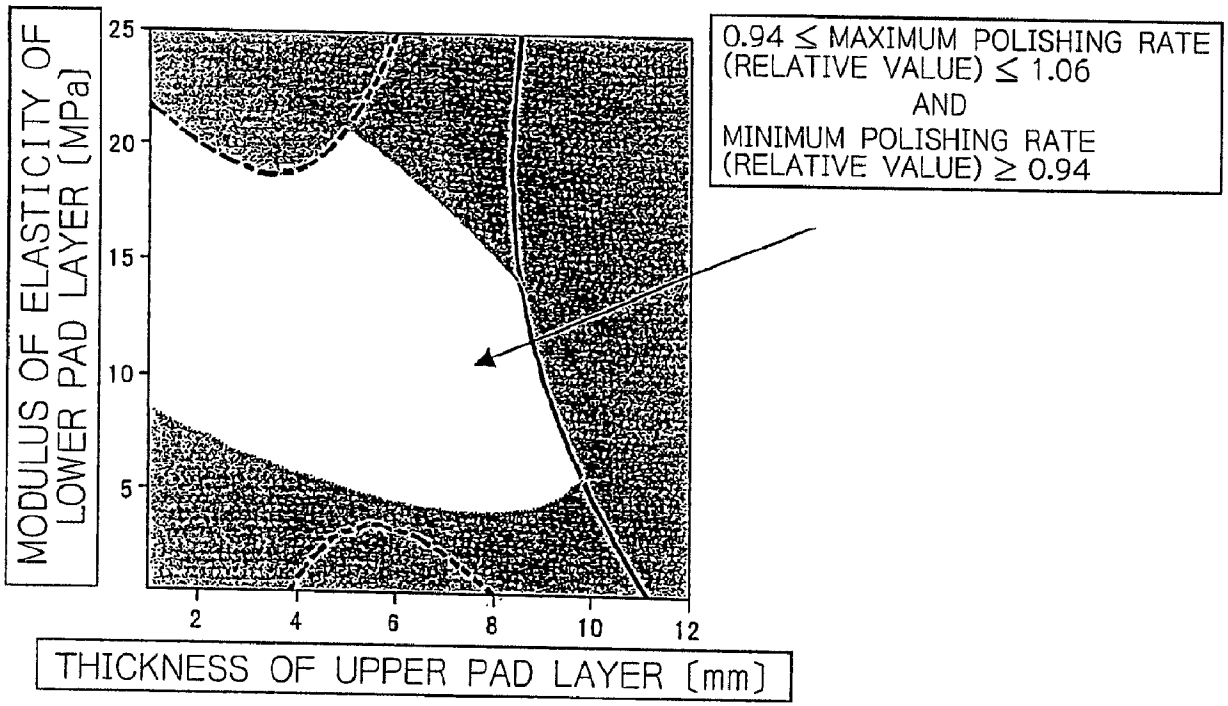
Figure 26:
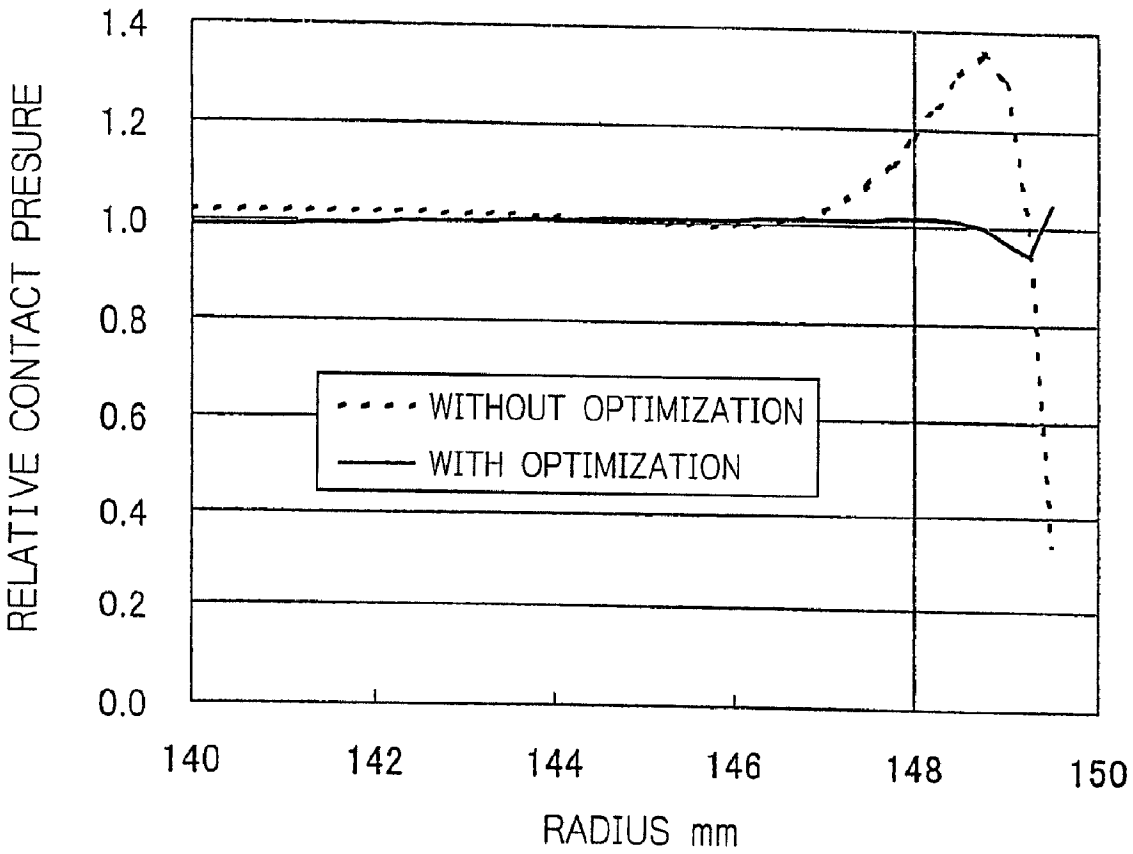
Figure 27:
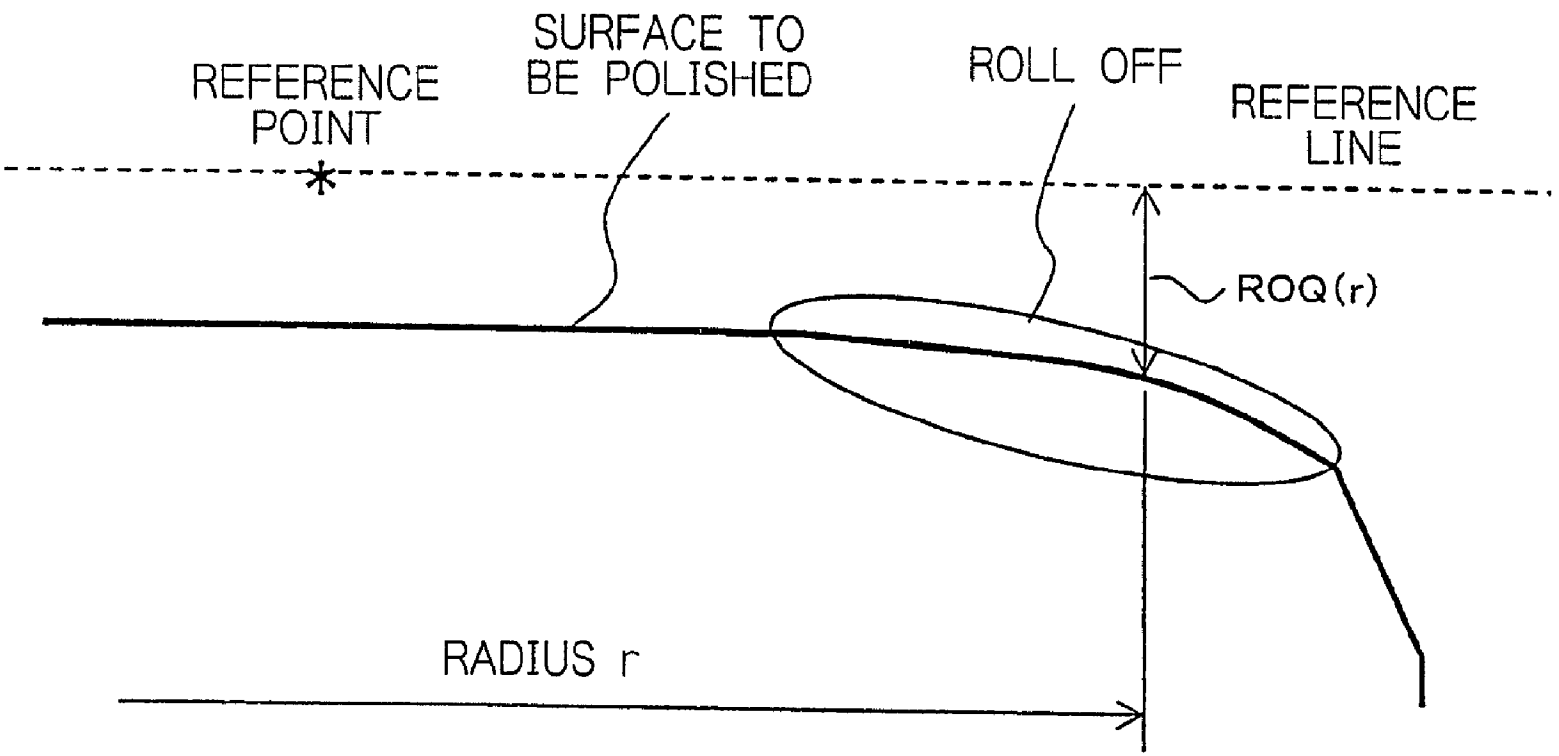

FIGS. 9(*a*) and 9(*b*) are top plan views each generally illustrating a supporting member of a polishing section in a fourth embodiment of the polishing apparatus according to the present invention;

FIG. 10 is a top plan view illustrating an example in which each supporting member illustrated in FIG. 9 is made up of a plurality of supporting elements;

FIG. 11 is a diagram generally illustrating a polishing section in cross-section and an associated control system in a fifth embodiment of the polishing apparatus according to the present invention;

FIG. 12 is a diagram generally illustrating an exemplary configuration of a pressure adjusting mechanism in FIG. 11;

FIG. 13 is a diagram generally illustrating a polishing section in cross-section and an associated control system in a sixth embodiment of the polishing apparatus according to the present invention;

FIG. 14 is a diagram generally illustrating a polishing section in cross-section and an associated control system in a seventh embodiment of the polishing apparatus according to the present invention;

FIG. 15 is a diagram showing the relationship between relative values of the maximum polishing rate and minimum polishing rate and an edge area pressing pressure;

FIG. 16 is a diagram generally illustrating a polishing section in cross-section and an associated control system in an eighth embodiment of the polishing apparatus according to the present invention;

FIG. 17 is a diagram showing the relationship between a supporting pressure of a retainer ring and an edge area pressing pressure;

FIG. 18 is a diagram showing suitable ranges for the modulus of elasticity and thickness of a polishing material in a single-layer pad;

FIG. 19 is a diagram showing suitable ranges for the modulus of elasticity and the thickness of a polishing material in the single-layer pad;

FIG. 20 is a table showing relative values of the maximum polishing rate and minimum polishing rate which are found based on FIGS. 18 and 19;

FIG. 21 is a diagram showing suitable ranges for the modulus of elasticity and the thickness of a polishing material in a two-layer pad;

FIG. 22 is a diagram showing suitable ranges for the modulus of elasticity and the thickness of a polishing material in the two-layer pad;

FIG. 23 is a diagram showing suitable ranges for the modulus of elasticity and the thickness of a polishing material in the two-layer pad;

FIG. 24 is a diagram showing suitable ranges for the modulus of elasticity and the thickness of a polishing material in the two-layer pad;

FIG. 25 is a table showing relative values of the maximum polishing rate and minimum polishing rate which are found based on FIGS. 21 to 24;

FIG. 26 is a diagram showing contact pressure distributions when the optimization according to the present invention is performed and is not performed; and FIG. 27 is a cross-sectional view illustrating a surface to be polished near the edge of a wafer for describing a roll off quantity.

DETAILED DESCRIPTION OF THE INVENTION

Figure 1:
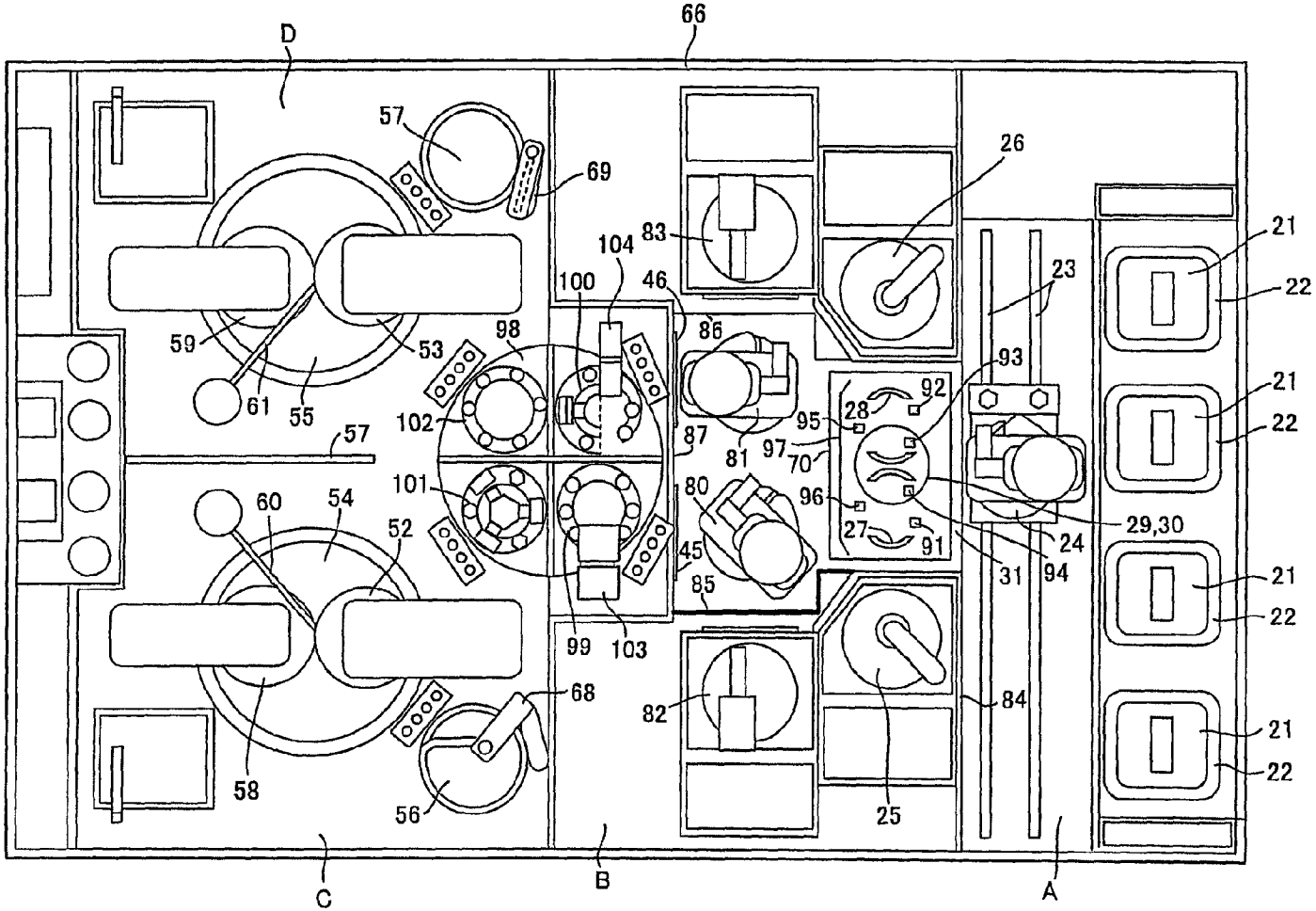
FIG. 1 is a top plan view illustrating the layout of respective components of a chemical mechanical polishing apparatus for polishing wafers.

In the following, several embodiments of a polishing apparatus according to the present invention will be described with reference to the accompanying drawings. FIG. 1 is a top plan view illustrating the layout of respective components in a chemical mechanical polishing apparatus for polishing wafers. The chemical mechanical polishing apparatus illustrated in FIG. 1 comprises four load/unload stages 22 for carrying wafer cassettes 21 which stock multiple wafers. The load/unload stages 22 may have a mechanism capable of hoisting and lowering. A carrier robot 24 having two hands is disposed on a running mechanism 23 such that the hands can reach each wafer cassette 21å on the load/unload stages 22.

Out of the two hands in the carrier robot 24, the lower hand is used only when a wafer is received from the wafer cassette 21, while the upper hand is used only when a wafer is returned to the wafer cassette 21. This is an arrangement for stocking clean wafers after washing above so that the wafers will no longer be contaminated. Preferably, the lower hand is an absorption-type hand for vacuum-absorbing a wafer, while the upper hand is a drop-in type hand for holding a wafer on the periphery. The absorption-type hand can correctly carry a wafer irrespective of shifts of wafers within the cassette, while the drop-in type hand can carry a wafer while the cleanness can be maintained on the back side of the wafer because it does not collect dust as does the vacuum absorption.

Two washing machines 25, 26 are disposed on the opposite side to the wafer cassettes 21 in symmetric arrangement about the running mechanism 23 of the carrier robot 24. Each of the washing machines 25, 26 is disposed at a position which can be accessed by the hands of the carrier robot 24, and a wafer station 70, which comprises four wafer seats 27, 28, 29, 30, is disposed at a position between the two washing machines 25, 26, which can be accessed by the carrier robot 24. The washing machines 25, 26 have a spin dry function for rotating wafers at high speeds for drying, thereby making it possible to support two-stage washing and three-stage washing of wafers without exchanging modules.

A barrier 84 is disposed for ranking the cleanness in an area B in which disposed are the washing machines 25, 26 and seats 27, 28, 29, 30 and in an area A in which disposed are the wafer cassettes 21 and carrier robot 24. The barrier 84 is provided with a shutter 31 in an opening for carrying a wafer between both areas A, B. A carrier robot 80 having two hands is disposed at a position from which the carrier robot 80 can access the washing machine 25 and three seats 27, 29, 30, and a carrier robot 81 having two hands is disposed at a position from which the carrier robot 81 can access the washing machine 26 and three seats 28, 29, 30.

The seat 27 is used for mutually passing a wafer between the carrier robot 24 and the carrier robot 80, and comprises a sensor 91 for sensing the presence or absence of a wafer. The seat 28 is used for passing a wafer between the carrier robot 24 and the carrier robot 81, and comprises a sensor 92 for sensing the presence or absence of a wafer. The seat 29 is used to carry a wafer from the carrier robot 81 to the carrier robot 80, and comprises a sensor 93 for sensing the presence or absence of a wafer, and a rinse nozzle 95 for preventing a wafer from drying or for washing the wafer. The seat 30 is used for carrying a wafer from the carrier robot 80 to the carrier robot 81, and comprises a sensor 94 for sensing the presence or absence of a wafer, and a rinse nozzle 96 for preventing a wafer from drying or for washing the wafer. The seats 29, 30 are disposed in a common water-proof cover, and a shutter 97 is provided in an opening for passing the water-proof cover therethrough. The seat 29 is positioned above the seat 30, so that a washed wafer is placed on the seat 29, while an unwashed wafer is placed on the seat 30. In this way, the wafer is prevented from contamination due to dropping rinse water. It should be noted that FIG. 1 schematically illustrates the sensors 91, 92, 93, 94, rinse nozzles 95, 96, and shutter 97, and may not correctly depict their positions and shapes.

The upper hand of the carrier robots 80, 81 is used to carry a wafer once washed to the washing machine or to the seat of the wafer station 70, while the lower hand is used to carry a wafer which has never been washed and a wafer before being polished. A wafer is carried to and from an inverter (hater described) by the lower hand, so that the upper hand will not be contaminated by droplets of the rinse water dripping from a wall above the inverter.

A washing machine 82 is disposed to be adjacent to the washing machine 25 and at a position which can be accessed by the hand of the carrier robot 80. Also, a washing machine 83 is disposed to be adjacent to the washing machine 26 and at a position which can be assessed by the hand of the carrier robot 81. All of these washing machines 25, 26, 82, 83, seats 27, 28, 29, 30 of the wafer station 70, and carrier robots 80, 81 are disposed in the area B in which the air pressure is adjusted to be lower than the air pressure in the area A. The washing machines 82, 83 are washing machines which can wash both sides of wafers.

The respective devices which make up the chemical mechanical polishing apparatus illustrated in FIG. 1 are surrounded by a housing 66, and the housing 66 is partitioned into a plurality of chambers by partitions 84, 85, 86, 87, 67 (including the areas A, B). The partition 87 defines a polishing chamber divided from the area B. This polishing chamber is partitioned by the partition 67 into an area C which is a first polishing section and an area D which is a second polishing section. Disposed in the respective areas C, D are two polishing tables, and a top ring for holding a wafer and polishing the wafer while pressing the wafer against the polishing table. Specifically, polishing tables 54, 56 are disposed in the area C, while polishing tables 55, 57 are disposed in the area D. Also, a top ring 52 is disposed in the area C, while a top ring 53 is disposed in the area D. Further disposed in the area C are an abrasive liquid nozzle 60 for supplying a polishing abrasive liquid to the polishing table 54, and a dresser 58 for dressing the polishing table 54, while disposed further in the area D are an abrasive liquid nozzle 61 for supplying a polishing abrasive liquid to the polishing table 55, and a dresser 59 for dressing the polishing table 55. In addition, a dresser 68 is disposed for dressing the polishing table 56 in the area C, while a dresser 69 is disposed for dressing the polishing table 57 in the area D. Alternatively, a wet type wafer thickness measuring device may be installed instead of the polishing tables 56, 57. In this event, the thickness of a wafer can be measured immediately after polishing, so that the wafer can be additionally polished, or the measured value can be utilized to control a polishing process for the next wafer.

For passing a wafer between the polishing chamber and the area B, a rotary wafer station 98, which comprises inverters 99, 100, 101, 102 for rotating wafers upside down, are disposed at locations which can be accessed by the carrier robots 80, 81 and top rings 52, 53. The inverters 99, 100, 101, 102 rotate in accompaniment with the rotation of the rotary wafer station. Displacement gages 103, 104 of probe type, optical type, electric type including an eddy current sensor, magnetic type, electromagnetic type, fluidics type, or the like, are provided above the rotary wafer station 98 for acquiring information in accordance with a roll off quantity on a surface to be polished of a wafer when the inverters 99-102 disposed in the rotary wafer station 98 are situated in the area B, i.e., at a position corresponding to the inverters 99, 100 in the layout of FIG. 1.

Here, a description will be given of a method of passing a wafer between the polishing chamber and the area B. Assume herein, in regard to the inverters provided in the rotary wafer station 98, that the inverters 99, 100 are disposed in the area B; the inverter 101 in the area C; and the inverter 102 in the area D. A wafer subjected to polishing is passed by the carrier robot 80 from the wafer station 70 to the inverter 99 disposed in the area B of the rotary wafer station 98. Another wafer is passed by the carrier robot 81 from the wafer station 70 to the inverter 100 disposed in the area B of the rotary wafer station 98. When the carrier robot 80 carries a wafer to the rotary wafer station 98, the shutter 45 arranged in the partition 87 opens so that the wafer can be passed between the area B and the polishing chamber. Also, when the carrier robot 81 carries a wafer to the rotary wafer station 98, the shutter 46 arranged in the partition 87 opens, so that the wafer can be passed between the area B and the polishing chamber. After the wafer has been passed to the inverter 99, the displacement gage 103 measures a roll off quantity of the surface to be polished of the wafer, and after the other wafer has been passed to the inverter 100, the displacement gauge 104 measures a roll off quantity of the surface to be polished.

As the measurements of the roll off quantities have thus been completed, the rotary wafer station 98 rotates by 180 degrees about its axis, causing the inverter 99 to move into the area D, and the inverter 100 into the area C. A wafer moved into the area C by the rotary wafer station is inverted by the inverter 100 such that the surface to be polished, now oriented upward, is oriented downward, and then delivered to the top ling 52. The wafer moved into the area D by the rotary wafer station is inverted by the inverter 99 such that the surface to be polished, now oriented upward, is oriented downward, and then delivered to the top ring 53. The wafers delivered to the top rings 52, 53 are absorbed by vacuum absorption mechanisms of the top rings, carried to the polishing table 54 or polishing table 55, while they remain absorbed, and then are polished by polishing pads mounted on the polishing tables 54, 55.

The following description will be given of an embodiment of a polishing section and an associated control system in the polishing apparatus according to the present invention.

Figure 2:
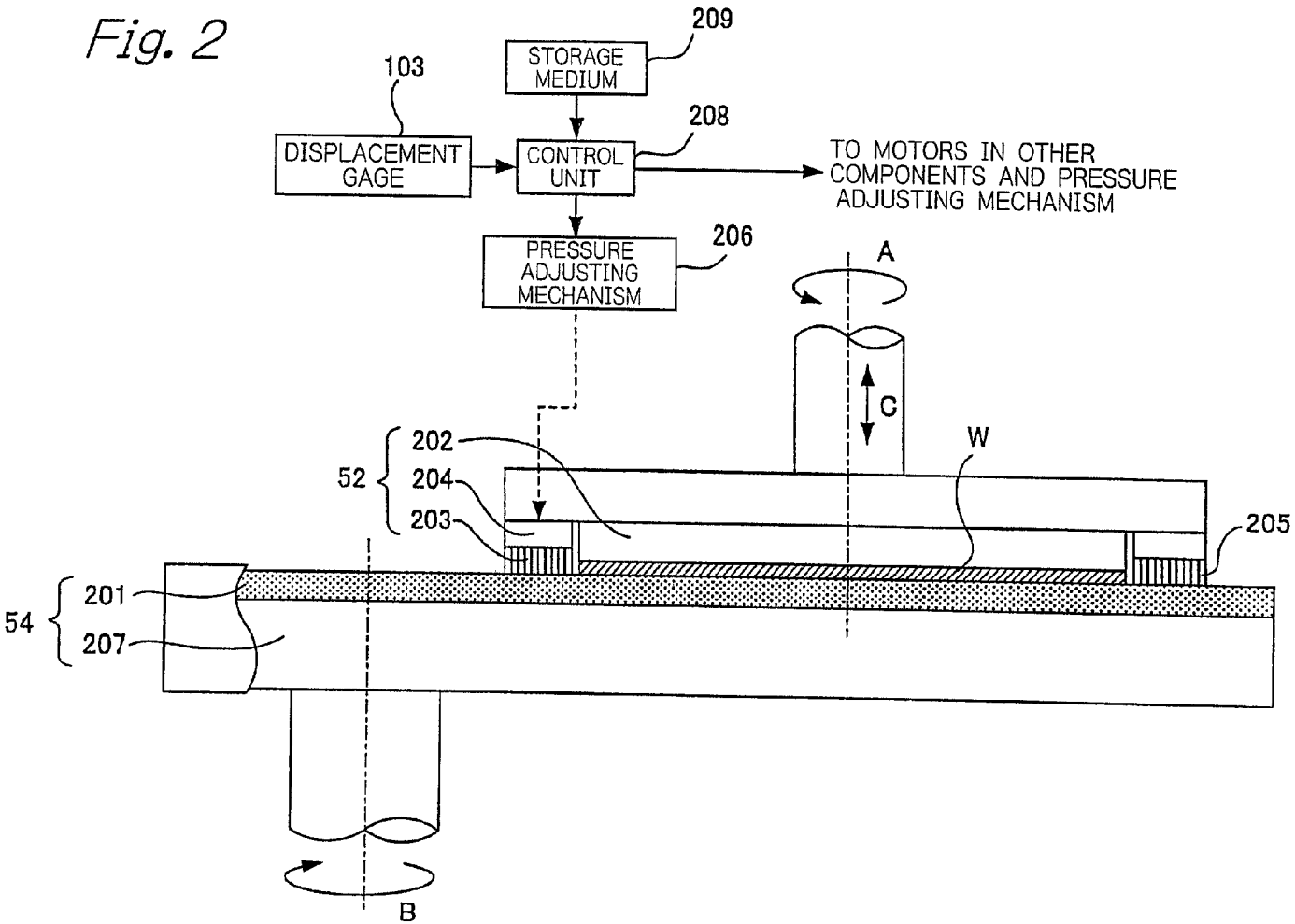
FIG. 2 is a diagram generally illustrating a polishing section in cross-section and an associated control system in a first embodiment of a polishing apparatus according to the present invention.

FIG. 2 is a diagram illustrating a first embodiment of the polishing section and associated control system in the polishing apparatus according to the present invention, wherein the polishing section comprises a top ring and a polishing table. FIG. 2 schematically illustrates a cross-sectional view of part of the top ring 52 and polishing table 54, and an example of the control system. The top ring 53 and polishing table 55 also have similar structures. As illustrated in FIG. 2, the top ring 52 is positioned such that a wafer W does not extend off the edge of a polishing pad 201. The top ring 52 for holding a wafer W, which is an object under polish, comprises an air bag 202 for pressing the wafer W against the polishing pad 201 with a predetermined pressure; a retainer ring 203 disposed to surround the wafer W; and an air bag 204 for pressing the polishing pad 201 around the wafer W against the retainer ring 203 with a predetermined supporting pressure. In the following description, a pressure with which the lower surface of the retainer ring 203 presses against the polishing pad 201 is called the "supporting pressure."

In the first embodiment herein described, the air bag 202 may have a single partition, as illustrated in FIG. 2, or a plurality of concentrically divided partitions. The retainer ring 203, in turn, is comprised of a single member which is in an annular shape along the outer periphery of the wafer held by the top ring 52, with a slight gap defined between itself and the outer periphery of the wafer, and has a rectangular cross-sectional shape. For reference, while this embodiment shows an example of the retainer ring 203 comprised of a single member, the retainer ring 203 may be comprised, for example, of a composite member such as a laminated member or the like. The lower surface of the member 205 defines a flat surface having substantially the same level thereacross so as to form a pressing surface for pressing against part of the polishing pad 201 which surrounds the periphery of the surface to be polished of the wafer W. The member 205 is preferably made, for example, of a ceramic material such as zirconia, alumina or the like, or an engineering plastic material such as epoxy (EP) resin, phenol (PH) resin, polyphenylene sulfide (PPS) resin or the like.

The supporting pressure which is applied to the polishing pad 201 by the retainer ring 203 is adjusted by controlling the pressure of the air bag 204 by a pressure adjusting mechanism 206. Alternatively, the air bag 204 may not be provided, but instead an axial load may be controlled by the pressure adjusting mechanism 206 to adjust the supporting pressure.

The polishing table 54 comprises a polishing pad 201 and a polishing surface plate 207. The polishing pad 201 may be a single-layer pad having a single layer as illustrated in FIG. 2 or a multi-layer pad having two or more layers. During polishing, the top ring 52 rotates in a direction of an arrow A about its axis, while pressing the wafer W against the polishing pad 201. Simultaneously, the polishing table 54 also rotates in a direction of an arrow B about its axis. In this event, when the supporting pressure of the retainer ring 203 is appropriately set in accordance with the measured roll off quantity, as later described, the polishing profile can be prevented from varying due to variations in the roll off, so that the wafer W can be polished with a practically sufficient flatness.

Turning back to FIG. 1, the aforementioned polishing tables 56, 57 are disposed at positions which can be accessed by the top rings 52, 53, respectively. In this way, wafers, after polished on the first polishing tables 54, 55, are polished for finishing by finish polishing pads adhered to the second polishing tables 56, 57. In the second polishing tables 56, 57 for finishing, pure water finishing is performed while the finish polishing pads are supplied with a chemical liquid which does not contain abrasive grains or pure water such as SUBA400, Polytex (both are product names of polishing pads manufactured by Rodel Nitta Company) or the like, or polishing is performed while a slurry is supplied.

During polishing, wafers next subjected to the polishing may be passed to the inverters 101, 102, which have moved into the area B, by the carrier robots 80, 81, and the roll off quantities may be measured by the displacement gages 103, 104. In doing so, since the polishing and the measurement of the roll off quantity can be simultaneously performed, the throughput of the polishing can be improved.

Wafers, which have been polished, are delivered to the inverters 99, 100, respectively, by the top rings 52, 53. The wafers delivered to the inverters 99, 100 are inverted by the inverters 99, 100, such that their surfaces to be polished are oriented upward. Subsequently, the rotary wafer station 98 rotates by 180 degrees to move the wafer into the area B. The wafer, which has been moved into the area B, are carried by the carrier robot 80 from the inverter 99 to the washing machine 82 or wafer station 70. The other wafer, which has moved to the area B, is carried by the carrier robot 81 from the inverter 100 to the washing machine 83 or wafer station 70. Subsequently, the wafers are stored in the wafer cassette 21 after an appropriate washing step.

In this embodiment, as a measuring unit for acquiring information in accordance with the roll off quantity of a surface to be polished of a wafer, the displacement gages 103, 104 are disposed above the rotary wafer station 98. However, it is arbitrary where in the polishing apparatus the measuring unit should be installed. Also, the measuring unit may not be integrated with the polishing apparatus. Alternatively, before introducing wafers into the polishing apparatus, a measuring device disposed external to the polishing apparatus may be used to previously measure the roll off quantity, and the information may be applied to a control unit 124 or a storage medium 126 through an input device, not shown. As the measuring device, there is an edge roll off measuring device (LER-100) manufactured by Kabushiki Kaisha KOBELCO Research Institute.

Next, a description will be given of a method of setting the supporting pressure for the retainer ring 203. For convenience of the description, the supporting pressure is represented as a relative value to a pressure with which the polishing pad 201 is pressed against the surface to be polished of the wafer W, i.e., a relative value to a polishing pressure. Assume that the roll off quantity of the surface to be polished of the wafer W is ROQ0 at the center of the wafer, and ROQ1 at a location spaced by 1 mm from the wafer edge. Used as ROQ1 may be an average value of those at several points on the wafer W in the circumferential direction, or a value at only one point selected as a representative value.

First, a difference ΔROQ=ROQ1−ROQ0 is calculated between the roll off quantity at the location spaced by 1 mm from the wafer edge and the roll off quantity at the center of the wafer. Next, a contact pressure corresponding to the calculated ΔROQ is found based on a previously established relationship between ΔROQ and the supporting pressure such that a region inside the edge exclusion becomes flat after polishing. Finally, the control unit 208 sets the supporting pressure of the retainer ring 203 to the contact pressure found above.

Figure 3:
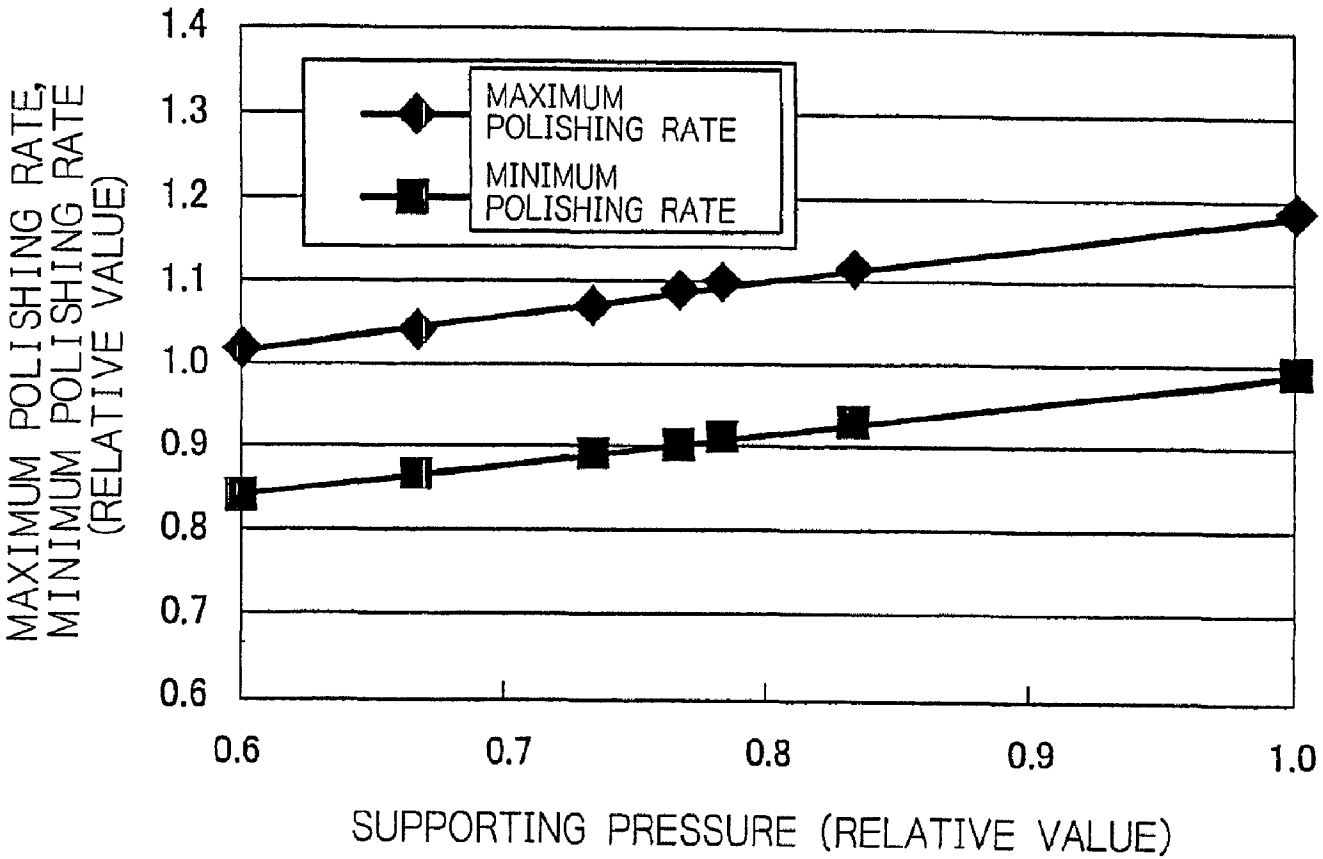
FIG. 3 is a graph showing the relationship between a maximum polishing rate and a minimum polishing rate and a supporting pressure in the polishing apparatus of FIG. 2.

Here, a description will be given of an example of a method of previously establishing the relationship between ΔROQ and the supporting pressure such that the region inside the edge exclusion becomes flat. FIG. 3 shows the relationship between relative values of a maximum polishing rate and a minimum polishing rate and the supporting pressure when the edge exclusion is chosen to be 2 mm on a wafer with ΔROQ=0.5 μm. In general polishing, a geometrically perfect flat surface cannot be created, but in semiconductor device manufacturing processes, for example, a lithographic process and the like, polishing to a practically sufficient flatness is sufficient. Therefore, assume in the following description that a surface polished to such a practically sufficient flatness is called a "flat surface." Also, it has been empirically recognized that by selecting an appropriate value for an allowance for variations in the polishing rate, a surface to be polished can have a sufficient flatness after polishing. Therefore, it can be said that when both the maximum polishing rate and minimum polishing rate fall within the allowance for variations in the polishing rate, the region inside the edge exclusion will become flat after polishing. Therefore, in the scenario of FIG. 3, when the allowance for variations in the polishing rate is chosen to be, for example, 1.0±0.1 in relative value of the polishing rate, it can be seen that the region inside the edge exclusion will become flat if the supporting pressure is set between approximately 0.75 times and 0.80 times higher than the polishing pressure.

A different ΔROQ will result in a different relationship between the relative values of the maximum polishing rate and minimum polishing rate and the supporting pressure. Therefore, when the supporting pressure have been found in the foregoing manner for each ΔROQ, the relationship between ΔROQ and the supporting pressure can be previously established such that the region inside the edge exclusion will become flat. However, since it is difficult to calculate the supporting pressures for all ΔROQ, the supporting pressures are actually calculated for ΔROQ at several points, and are interpolated between these points using an interpolation equation.

The foregoing example of setting the supporting pressure uses the difference ΔROQ between the roll off quantity at the location spaced by 1 mm from the wafer edge and the roll off quantity at the center of the wafer. However, the setting of the supporting pressure is not limited to the setting with reference to the foregoing ΔROQ, but the setting may be made with reference to ROA described in Non-Patent Document 2, or a coefficient when the roll off quantity is approximated by an approximation equation such as a polynomial, as long as it is information based on the roll off quantity.

Information on the relationship between ΔROQ and the supporting pressure previously established such that the region inside the edge exclusion will become flat is stored in a storage medium 209. The supporting pressure is controlled based on the result of measuring a roll off quantity on a surface to be polished of a wafer W, acquired by the displacement gage 103, with the information on the relationship between ΔROQ and the supporting pressure previously established such that the region inside the edge exclusion will become flat, and a program for accessing the information. The storage medium 209 may store, other than the aforementioned information and program, a program for controlling the supporting pressure on the supporting surface based on the result of measuring the roll off quantity on the surface to be polished of the wafer W, acquired by the displacement gage 103. The storage medium 209 can also store a program for controlling other components which make up the polishing apparatus, including the top rings 52, 53, motors for driving the polishing tables 54, 55, 56, 57, displacement gages 103, 104, carrier robots 80, 81, and the like.

As will be understood from the foregoing description, in the first embodiment of the present invention, the influence of the rebound of the polishing pad 201 on the wafer W can be reduced by optimizing the supporting pressure in accordance with variations in the roll off quantity of the wafer W.

Figure 4:
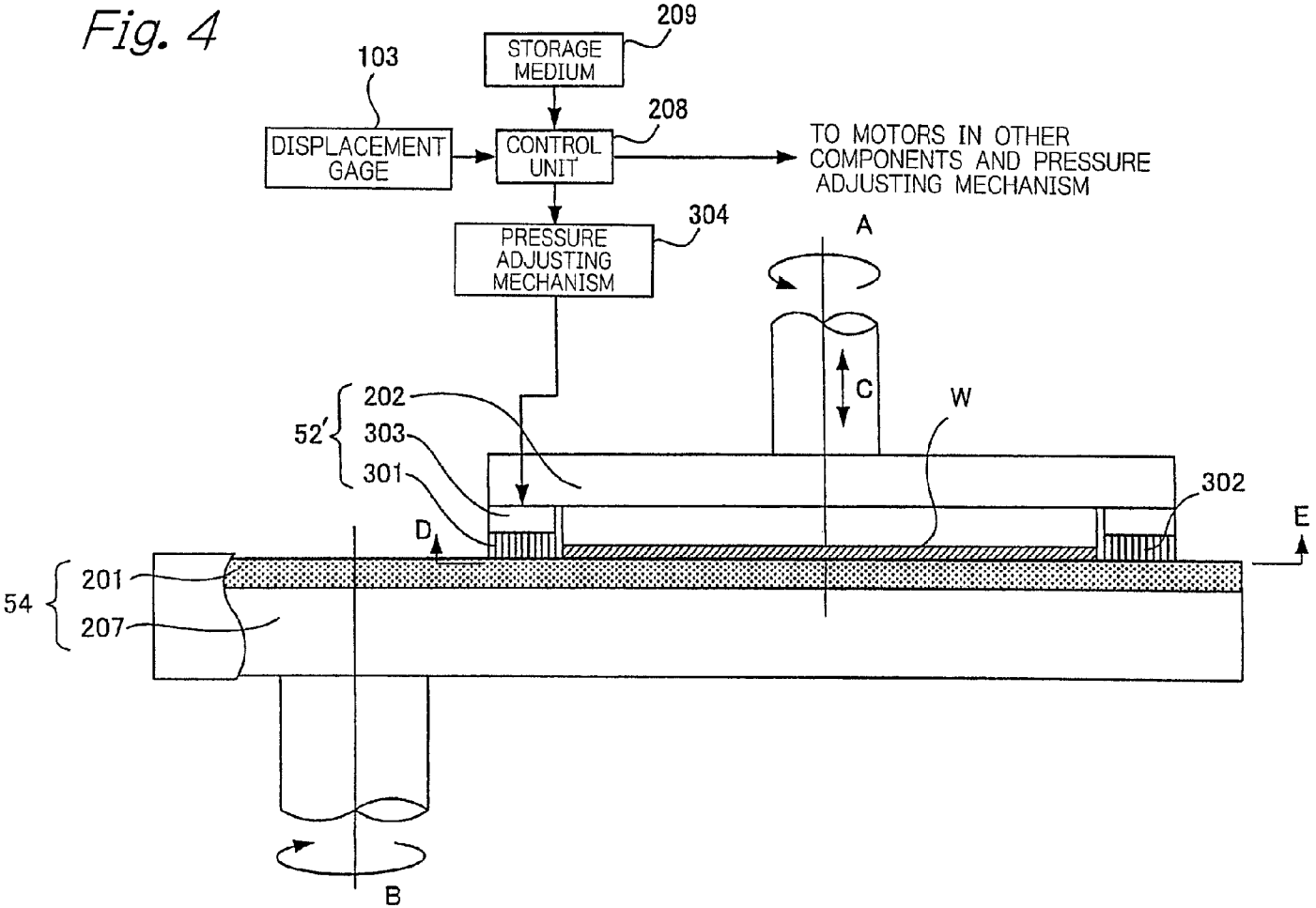
FIG. 4 is a diagram generally illustrating a polishing section in cross-section and an associated control system in a second embodiment of the polishing apparatus according to the present invention.
Figure 5:
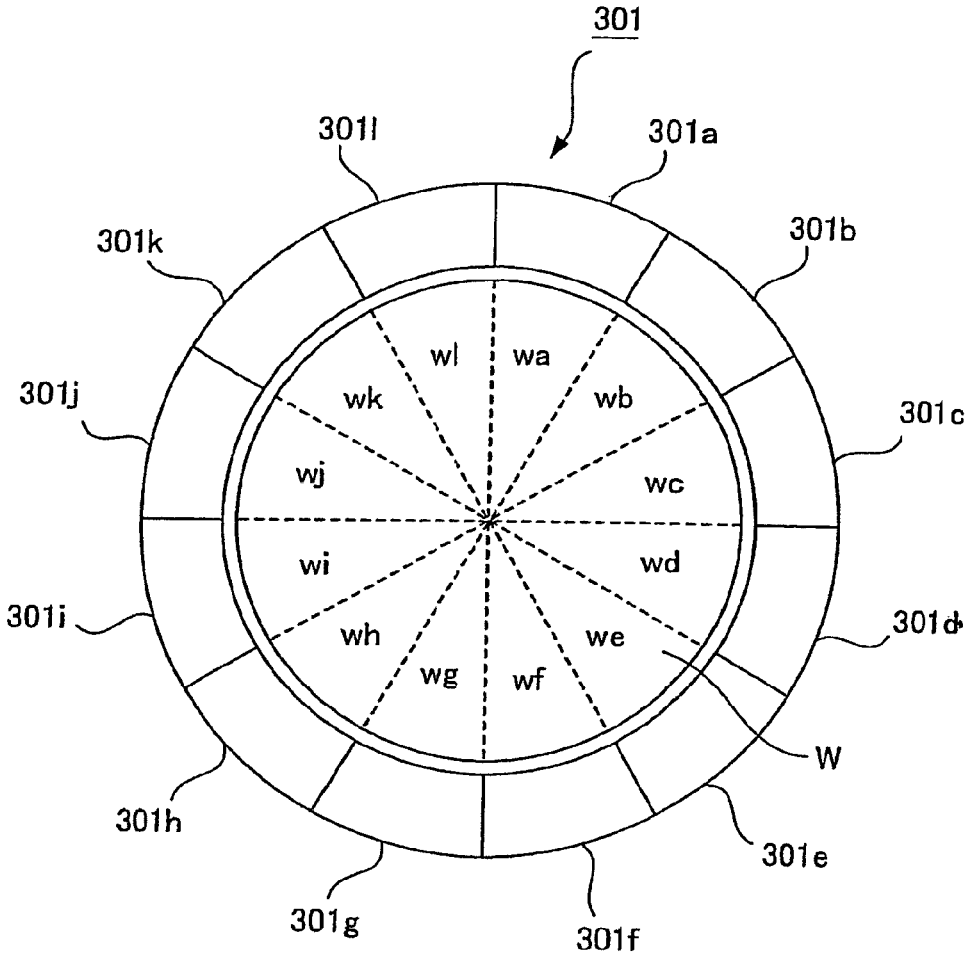
FIG. 5 is a top plan view illustrating an example of a retainer ring in FIG. 4.

FIG. 4 is a diagram schematically illustrating a polishing section in cross-section and an associated control system in a second embodiment of the polishing apparatus according to the present invention. Like the first embodiment illustrated in FIG. 2, the polishing section comprises a top ring and a polishing table, and FIG. 4 schematically illustrates a cross-sectional view of part of a top ring 52' and a polishing table 53, and an example of the control system. FIG. 5 is a cross-sectional view when viewed in the direction of the arrows D, E along a line DE in FIG. 4. In FIGS. 4 and 5, components identical or corresponding to the components in FIG. 2 are designated the same reference numerals, and repeated description thereon is omitted. Therefore, the following description will be centered on different aspects of the second embodiment of the present invention from the first embodiment.

First, the second embodiment employs a retainer ring 301 made up of a plurality of pressing members having a pressing surface for pressing a polishing pad 201, instead of the single retainer ring 203 in FIG. 2. Specifically, the retainer ring 301 is made up of a predetermined number of independent pressing members which are sequentially arranged along the periphery of a wafer W and separated from each other by a predetermined angle along a plane which is passed by the center axis of the top ring 52'. In FIG. 5, the retainer ring 301 is made up of 12 independent pressing members 301*a*-301*l* which are sequentially arranged along the periphery of the wafer W, and separated from each other by 30° along the plane which is passed by the center axis of the top ring 52'. As illustrated in FIGS. 4 and 5, the pressing member 301*a* comprises a single member 302 having an arc shape in the lengthwise direction and a rectangular cross-section, which is formed such that its inner peripheral surface runs along the periphery of the wafer W with a slight gap defined therebetween. While this embodiment shows an example in which the pressing member 301*a* and the like comprise single members, each of them may comprise a composite member, for example, a laminated member or the like. The lower surface of the member 302 functions as a pressing surface for pressing a portion of the polishing pad which surrounds the periphery of a surface under polishing of the wafer W, and generally forms a flat surface having the same level. The other pressing members 301*b*-301*l* are formed in the same manner as the pressing member 301*a*. As a result, the 12 pressing members are brought into contact with each other to form a ring member having a rectangular cross-section, which is disposed along the periphery of the wafer W with a slight gap defined therebetween.

Also, the second embodiment of the present invention comprises an air bag 303 comprised of 12 independent sub-air bags which can independently apply supporting pressures to 12 pressing members 301*a*-301*l*, respectively, and a pressure adjusting mechanism 304 comprised of 12 independent sub-pressure adjusting mechanisms for adjusting the pressures of the respective sub-air bags, instead of the single air bag 204 in FIG. 2. For example, the pressing member 301*a* is provided with a sub-air bag and sub-pressure adjusting mechanism associated therewith, such that an air pressure supplied to the sub-air bag is controlled by this sub-air pressure adjusting mechanism to independently control the supporting pressure of the pressing member 301*a*. In the second embodiment illustrated in FIGS. 4 and 5, since air pressures applied to the 12 sub-air bags are individually adjusted by the sub-pressure control mechanisms respectively provided to be associated therewith, the 12 pressing members 301*a*-301*l* can press the polishing pad 201 with independent supporting pressures, respectively.

In the second embodiment, the control unit 208 controls each sub-pressure control mechanism to adjust the supporting pressure of each sub-air bag. The other top ring is configured and controlled in the same manner as the top ring 52'. The control unit 208 can individually control air pressures applied to the sub-air bags provided to be associated with the respective pressing members 301*a*-301*l* from information based on the roll off quantity on a surface to be polished of a wafer W, and respectively adjust the supporting pressures of the respective pressing members to set them to desired supporting pressures. Such settings of the supporting pressures are similar to the setting of the supporting pressure for the retainer ring 203 in the aforementioned first embodiment.

As will be understood from the foregoing description, the second embodiment of the present invention also provides similar advantages to the aforementioned first embodiment. Further, the second embodiment can cope with variations in the roll off in the circumferential direction by adjusting the supporting pressures applied to the polishing pad by the respective pressing members 301*a*-301*l* with reference to the information based on the roll off quantities of areas Wa-Wl of the wafer W associated with the pressing members 301*a*-301*l*, respectively, to set them to desired supporting pressures.

For example, the supporting pressure of the pressing member 301*a* is set to a supporting pressure corresponding to ΔROQ at an arbitrary position on the surface to be polished in the area Wa of the wafer W. Similarly, the supporting pressure of the pressing member 301*b* is set to a supporting pressure corresponding to ΔROQ at an arbitrary position on the surface to be polished in the area Wb of the wafer W. Such an operation is performed for all of the 12 pressing members 301*a*-301*l*. While the foregoing description has been given of a method of setting the supporting pressures based on ΔROQ, any method may be employed as long as the method controls the supporting pressures with reference to information based on the roll off quantities. For example, the supporting pressure of the pressing member 301*a* may be set to a supporting pressure corresponding to an average of a plurality of ΔROQ's calculated from the roll off quantities over the surface to be polished in the area Wa of the wafer W, and the supporting pressures may be set in all of the remaining pressing members in a similar manner. Alternatively, the supporting pressure may be set to a supporting pressure corresponding to ROA at an arbitrary position in each area of the wafer W associated with each pressing member, or may be set to a supporting pressure corresponding to an average of a plurality of ROA's in each area of the wafer W. These aspects are applied to respective embodiments, later described, as well.

The first embodiment and second embodiment described above relate to a large-diameter polishing member rotation type polishing apparatus. The following description will be given of an embodiment in which the present invention is applied to a small-diameter polishing member rotation scanning polishing apparatus. Likewise, in this embodiment, optimal polishing profiles can be found in accordance with variations in the roll off quantity of a wafer.

Figure 6:
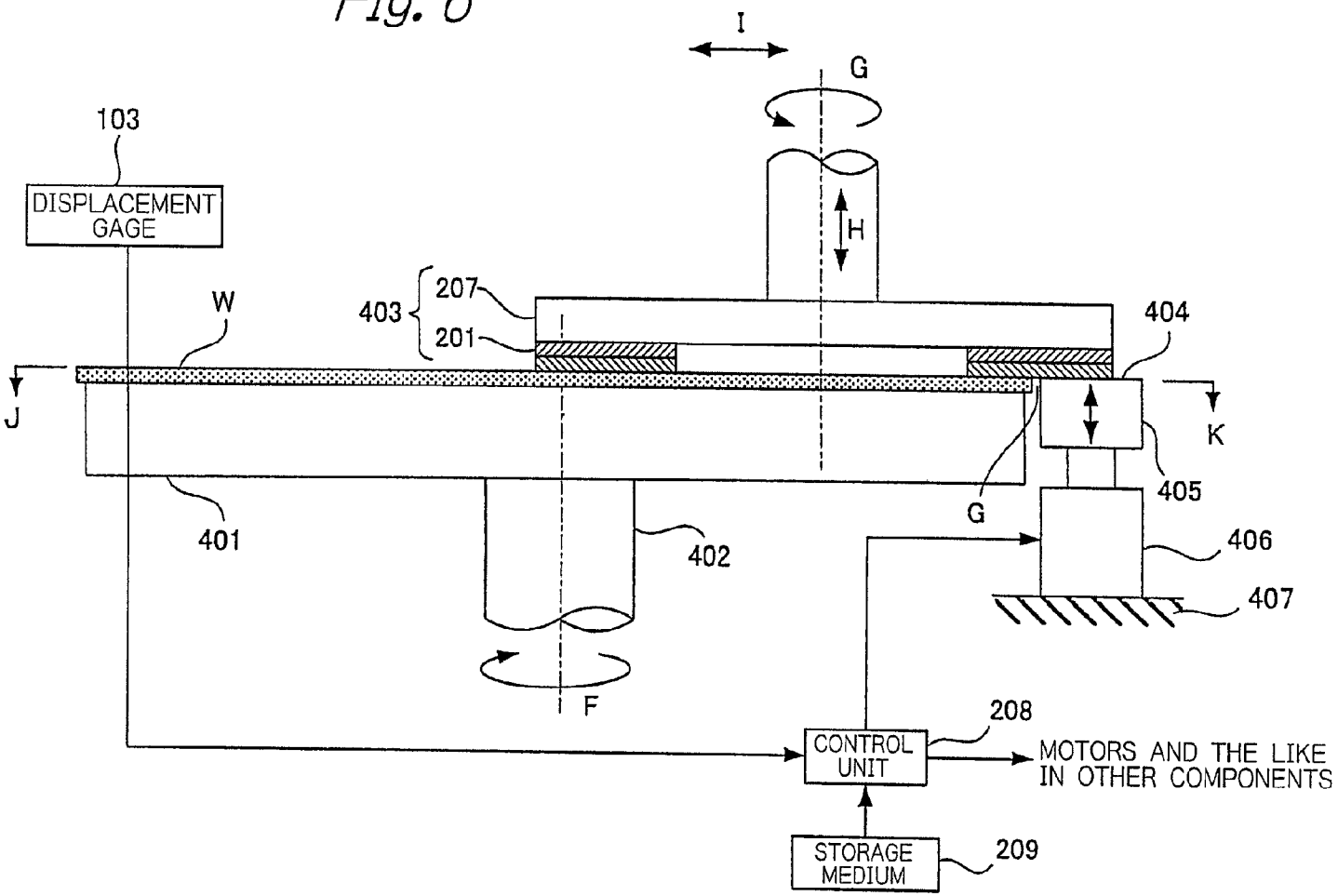
FIG. 6 is a diagram generally illustrating a polishing section in cross-section and an associated control system in a third embodiment of the polishing apparatus according to the present invention.
Figure 7:
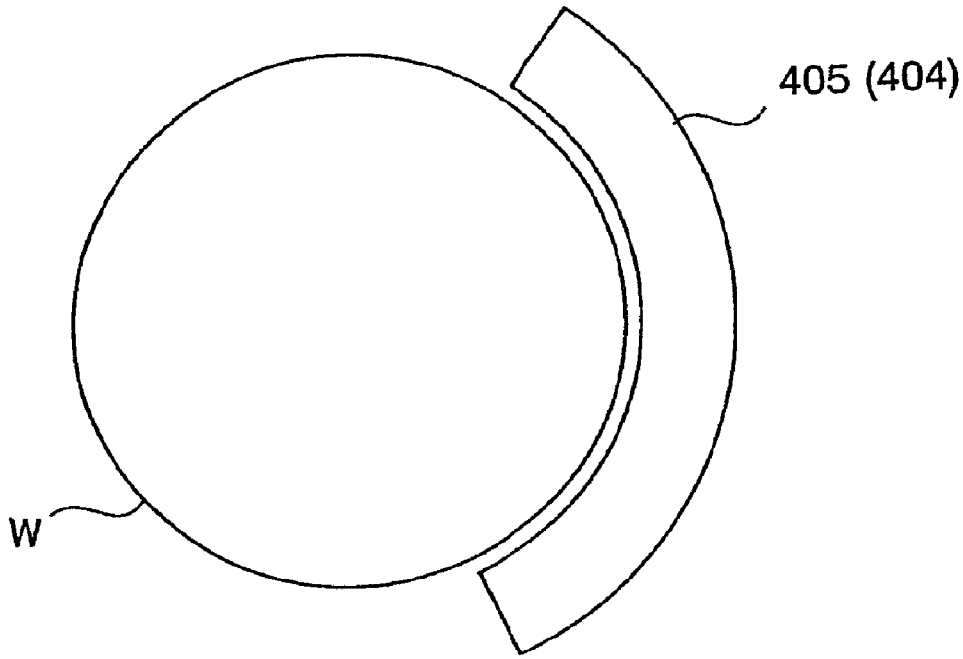
FIG. 7 is a cross-sectional view when viewed in a direction of arrows J, K along a line JK in FIG. 6.

FIG. 6 is a diagram schematically illustrating a polishing section in cross-section and a control system in a third embodiment of the polishing apparatus according to the present invention, and FIG. 7 is a cross-sectional view when viewed in a direction of allows J, K along a line JK in FIG. 6. Components identical or corresponding to the components in FIGS. 2 and 4 are designated the same reference numerals, and repetitive description thereon is omitted.

In the third embodiment, the polishing section comprises a wafer holding unit and a wafer polishing unit. As a wafer holding unit for appropriately holding a wafer W, a vacuum chuck 401 is provided, as illustrated in FIG. 6. The vacuum chuck 401, which is made in a discoidal shape, can vacuum-absorb the wafer W with a mechanism (not shown) capable of vacuum absorption to hold the wafer W on its top surface, with a surface to be polished of the wafer W being oriented upward. One end of a shaft 402 is secured to the bottom surface of the vacuum chuck 401, and a lower end of the shaft 402 is coupled to an electric motor (not shown). In this way, as the electric motor (not shown) rotates the shaft 402 in a direction of an arrow F in FIG. 6, the vacuum chuck 601 also rotates in the same direction.

On the other hand, the wafer polishing unit comprises a polishing head and a supporting member. The polishing head 403 has a polishing pad 201 disposed on the lower surface of the polishing surface plate 207 as a polishing member, as illustrated in FIG. 6. In the example illustrated in FIG. 6, a two-layer polishing pad is used as the polishing pad 201, but the present invention is not limited to this one. The polishing head 403 is supported by a mechanism (not shown) which has an electric motor as an actuator for rotations in directions indicated by arrows G, H, I in FIG. 6 and for swinging movements in the vertical direction and horizontal direction. The polishing surface plate 207 is also supported to have an angle following characteristic. The diameter of the polishing pad 201 is smaller than the diameter of the wafer W. When the wafer W is polished, a swinging movement of the polishing head 403 in the direction of the arrow I can cause part of the polishing pad 201 to temporarily extend off the end of the wafer W to the right as viewed in FIG. 6. FIG. 6 illustrates that the polishing pad 201 extends off to its maximum to the right. The polishing head 403 has a mechanism (not shown) for supplying a polishing assistant such as a slurry, which is configured such that the polishing assistant can be supplied to the polishing pad 201 and wafer W from a liquid supply hole formed at the center of rotation through the lower surface of the polishing surface plate 207.

As illustrated in FIGS. 6 and 7, the supporting member 404 comprises a single member 405 (FIG. 7) having an arc shape and a rectangular cross-section, which runs along the periphery of the wafer W with a slight gap defined therebetween. For reference, the member 405 may comprise a composite member, for example, a laminated member or the like, instead of the single member. The upper surface of the member 405 functions as a supporting surface for pushing up or supporting a portion of the polishing pad 201 extending off the edge of the wafer W with a predetermined pressure, and generally forms a flat surface having the same level, i.e., substantially parallel with the surface to be polished of the wafer W held by the vacuum chuck 401. In the following, the pressure with which the supporting member pushes up a portion of the polishing pad 201 which extends off the edge of the wafer W is called the "supporting pressure." The member 405 is preferably made of, for example, of a ceramic material such as zirconia, alumina or the like, or an engineering plastic material such as an epoxy (EP) resin, a phenol (PH) resin, a polyphenylene sulfide (PPS) resin or the like.

As illustrated in FIG. 6, the third embodiment is provided with a height adjusting mechanism 406 which can adjust and set the height of a supporting surface which supports a portion of the polishing pad 201 extending off the edge of the wafer in the supporting member 404 (i.e., the level of the top surface of the member 405 in the vertical direction in FIG. 6). In this embodiment, the bottom surface of the height adjusting mechanism 406 is fixed on the base (base member) 407, and the top surface thereof is provided with a mechanism which is mechanically coupled to the supporting member 404 for adjusting and setting the height of the supporting surface of the supporting member 404 with reference to the surface to be polished of the wafer W. As illustrated, the supporting member 404 is configured independently of the vacuum chuck 401, and will not rotate together with the vacuum chuck 401.

Utilized as the height adjusting mechanism 406 can be a known highly accurate positioning mechanism, for example, a precision positioning mechanism which uses ball screws. As illustrated in FIG. 6, in the polishing apparatus according to this embodiment, a displacement gage 103 of probe type, optical type, electric type including an eddy current sensor, magnetic type, electromagnetic type, fluidics type, or the like, is provided as a measuring unit for acquiring information in accordance with a roll off quantity of the surface to be polished of the wafer W when it is held by the vacuum chuck 401. The displacement gage 103 measures a roll off quantity of the surface to be polished of the wafer W, before polishing, held by the vacuum chuck 401, relying on a reference point which is a predetermined position on the surface to be polished of the wafer on the vacuum chuck 401. However, the method of measuring a roll off quantity is not limited to this one, but a roll off quantity of the wafer W before it is held by the vacuum chuck 401, for example, may be measured to find the roll off quantity of the wafer W. As a measuring device for this purpose, there is, for example, an edge roll off measuring device (LER-100) of Kabushiki Kaisha KOBELCO Research Institute or the like. Alternatively, the roll off quantity may be measured for a wafer which is being polished. The height of the surface to be polished of the wafer W can be known from the roll off quantity of the wafer W using a geometrical position such as a wafer holding surface, a measured site or the like on the vacuum chuck 401 and displacement gage 103 in the polishing apparatus of this embodiment, or the edge roll off measuring device. The roll off quantity on the surface to be polished of the wafer W, which is the result of the measurement from the displacement gage 103, is used to control the height adjusting mechanism 406 by the control unit 208.

The operation of the polishing apparatus according to the third embodiment of the present invention is controlled by the control unit 208. Specifically, the control unit 208 controls the aforementioned motors in the respective components, displacement gage 103, the carrier robot (not shown) for passing the wafer W to vacuum chuck 401, the carrier robot (not shown) for receiving the wafer W from the vacuum chuck 401, and the like to perform the following operation. As the wafer W is passed to the vacuum chuck 401 by the carrier robot, not shown, the displacement gage 103 measures a roll off quantity on the surface to be polished of the wafer W which is held by the vacuum chuck 401. The control unit 208 operates the height adjusting mechanism 406 based on the roll off quantity on the surface to be polished of the wafer W to adjust the height of the supporting surface of the supporting member 404 to set the supporting surface to a desired height. The setting of the height of the supporting surface of the supporting member 404, and resulting effects will be described later. Alternatively, the height of the supporting surface of the member 405 may be set by correcting by a height in accordance with the roll off quantity from a height which is set based on the thickness of the wafer W.

As illustrated in FIG. 6, the wafer W is polished by rotating and swinging (i.e., scanning) the polishing head 403 while the polishing head 403 is pressed against the surface to be polished of the wafer W with a predetermined pressure. When the wafer W is being rotated while the chuck 401 is also being rotated to perform relative motions between the wafer W and polishing head 403, a polishing assistant is supplied from the polishing head 403 onto the wafer W, as mentioned above. Thus, the polishing assistant spreads on the wafer W, and introduces between the polishing pad 201 and wafer W, with the accompaniment of the relative motions of the polishing head 403 and wafer W to polish the surface to be polished of the wafer W. Stated another way, the mechanical polishing by the relative motions of the polishing head 201 and wafer W synergically works with the chemical action of the polishing assistant to polish the wafer W. As will be apparent to those skilled in the art, polishing conditions such as the type of the polishing assistant and polishing pad 201, the rotational speeds of the polishing head 403 and vacuum chuck 401, the swinging speed of the polishing head 403, swinging amount, and the like are set to those suited to the planarization of the surface to be polished.

Alternatively, roll off quantities may be sequentially measured by the displacement gage 103 on the surface to be polished of the wafer W under polishing, to adjust the height of the supporting surface of the supporting member 404 to comply with the result of the measurement, to set the supporting surface to a desired height. The wafer W, which has been polished, is carried by the carrier robot (not shown) to a place where a washing step and the like are performed.

Here, a description will be given of an exemplary method of setting the height of the supporting surface of the supporting member 404 and effects resulting therefrom. For convenience of description, assume that the height of the surface to be polished at the center of the wafer W is defined to be zero, and a sign "+" is added when the polishing surface of the polishing pad (in other words, the supporting surface of the supporting member 404) is higher than the height of the surface to be polished, and a sign "−" is added when the polishing surface of the polishing pad (in other words, the supporting surface of the supporting member 404) is lower than the height of the surface to be polished. For reference, this method is relied on to designate the signs of numerical values on the horizontal axis in FIG. 8 (height of the supporting surface).

Described first is an exemplary method of setting the height of the supporting surface of the supporting member 404. Assume that the roll off quantity of the surface to be polished of the wafer W is ROQ0 at the center of the wafer, and ROQ1 at a location spaced by 1 mm from the wafer edge. ROQ1 may be an average value of those at several points on the wafer W in the circumferential direction, or a value at only one point used as a representative value. First, a difference ΔROQ=ROQ1−ROQ0 is calculated between the roll off quantity at the location spaced by 1 mm from the wafer edge and the roll off quantity at the center of the wafer. Next, a height of supporting surface corresponding to the calculated ΔROQ is found based on a previously established relationship between ΔROQ and the height of the supporting surface such that a region inside the edge exclusion becomes flat after polishing. Finally, the control unit 208 sets the height of the supporting surface of the supporting member 404 to the height found in the foregoing manner.

Figure 8:
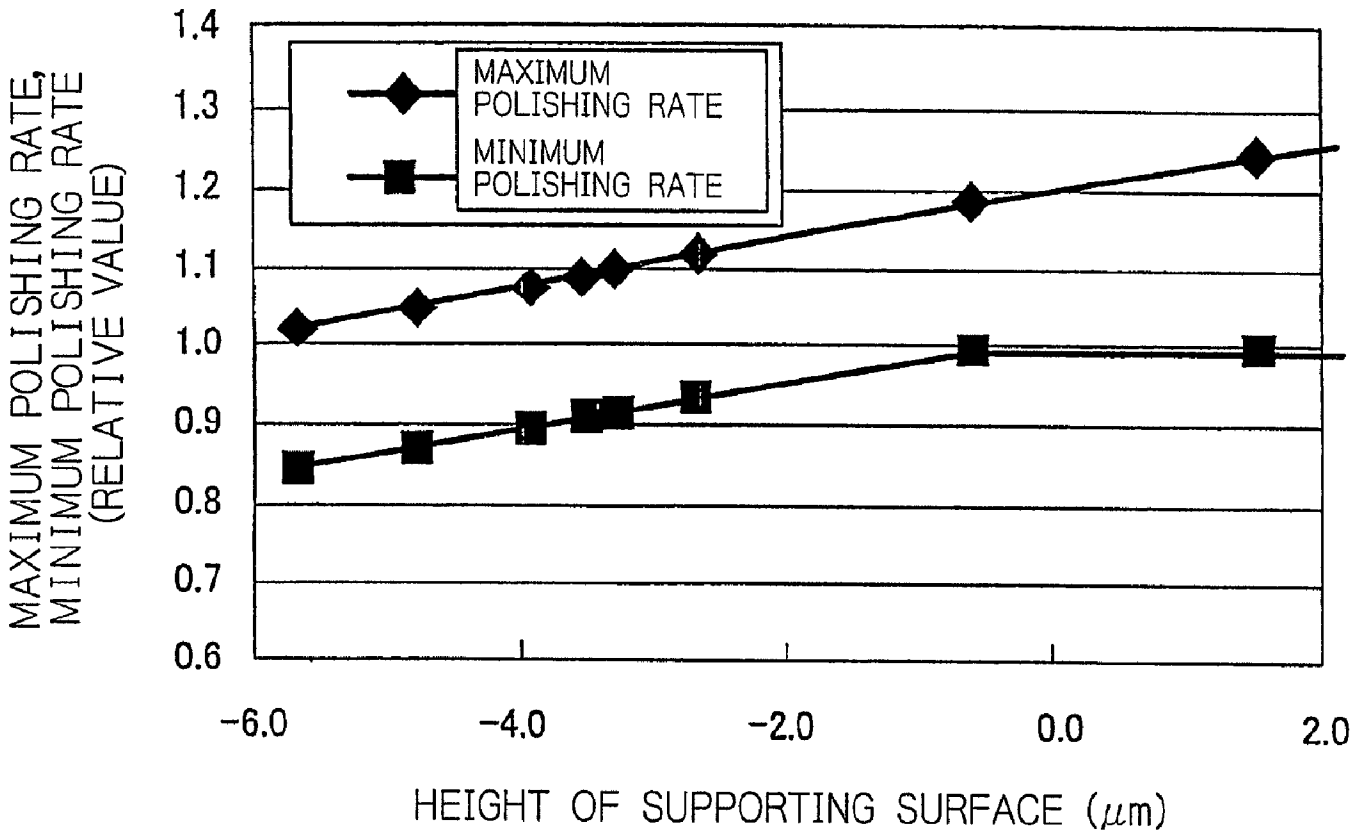
FIG. 8 is a graph showing the relationship between the maximum polishing rate and minimum polishing rate and the height of a supporting surface in the polishing apparatus of FIG. 6.

Now, a description will be given of an example of a method of previously establishing the relationship between ΔROQ and the height of the supporting surface such that the region inside the edge exclusion becomes flat. FIG. 8 shows the relationship between relative values of a maximum polishing rate and a minimum polishing rate and the height of the supporting surface when the edge exclusion is chosen to be 2 mm on a wafer with ΔROQ=0.5 μm. In general polishing, a geometrically perfect flat surface cannot be created, but in semiconductor device manufacturing processes, for example, a lithographic process and the like, polishing to a practically sufficient flatness is sufficient. Therefore, assume in the following description that a surface polished to such a practically sufficient flatness is called a "flat surface." Also, it has been empirically recognized that by selecting an appropriate value for an allowance for variations in the polishing rate, a surface to be polished after polishing can have a sufficient flatness. Therefore, when both the maximum polishing rate and minimum polishing rate fall within the allowance for variations in the polishing rate, the region inside the edge exclusion will become flat after polishing. As such, in the scenario of FIG. 8, supposing that the allowance for variations in the polishing rate is chosen to be, for example, 1.0±0.1 in relative value of the polishing rate, the region inside the edge exclusion will become flat if the height of the supporting surface is set to fall within a range of approximately −3.3 μm to −3.7 μm.

A different ΔROQ will result in a different relationship between the relative values of the maximum polishing rate and minimum polishing rate and the height of the supporting surface. Therefore, once the height of the supporting surface is found in the foregoing manner for each ΔROQ, the relationship between ΔROQ and the height of the supporting surface can be previously established such that the region inside the edge exclusion will become flat. However, since it is difficult to calculate the height of the supporting surface for all ΔROQ, the heights of the supporting surfaces are actually calculated for ΔROQ at several points, and are interpolated between these points using an interpolation equation.

The foregoing example of setting the height of the supporting surface uses the difference ΔROQ between the roll off quantity at the location spaced by 1 mm from the wafer edge and the roll off quantity at the center of the wafer. However, the setting of the height of the supporting surface is not limited to the setting with reference to ΔROQ, but the setting may be made with reference to ROA described in Non-Patent Document 2, or a coefficient when the roll off quantity is approximated by an approximation equation such as a polynomial, because it is only required to be information based on the roll off quantity. Also, for convenience of description, the height of the supporting surface is based on the height of the surface to be polished at the center of the wafer W, but may be based on the height at an arbitrary position on the surface to be polished of the wafer W. However, the height of the supporting surface is preferably based on the height at a position at which the surface to be polished of the wafer W is regarded to become flat.

Information on the relationship between ΔROQ and the height of the supporting surface previously established such that the region inside the edge exclusion will become flat is stored in a storage medium 209. The control unit 208 comprises a program for accessing the information stored in the storage medium 209 to control the height of the supporting surface based on the result of measuring a roll off quantity on the surface to be polished of the wafer W, acquired by the displacement gage 103. The storage medium 209 may store, other than the aforementioned information and program, a program for controlling the height of the supporting surface based on the result of measuring the roll off quantity on the surface to be polished of the wafer W, acquired by the displacement gage 103. The storage medium 209 can also store a program for controlling the aforementioned motors in the respective components, displacement gage 103, and carrier robots. The storage medium 209 may be physically independent of the control unit 208 or may be physically incorporated in the control unit 208.

As the height of the supporting surface of the supporting member 404 is set in the foregoing manner, the wafer W is less affected by the rebound of the polishing pad 201 of the polishing head 403 during polishing, thus making it possible to reduce the edge exclusion from this aspect, as well as to polish the wafer to become flat irrespective of the roll off quantity. Also, since the polishing head 403 does not substantially incline, the edge first is reduced, resulting in a further reduction in the edge exclusion.

In the third embodiment of the present invention, since the height of the supporting member 404 is adjusted based on the roll off quantity on the surface to be polished of the wafer W, acquired by the displacement gage 103, the height of the supporting member 404 can be set to a desired height with reference to the surface to be polished of the wafer W, irrespective of variations in roll off of the individual wafer W, thus appropriately producing predetermined advantages. Specifically, the wafer W can be less affected by the rebound of the polishing pad 201 of the polishing head 403 by optimizing the height of the supporting member 404 in accordance with variations in the roll off quantity of the wafer W.

In the third embodiment of the present invention, the supporting member 404 is disposed only at a location at which the polishing pad 201 of the polishing head 403 extends off the wafer W with respect to the vacuum chuck 401, but the supporting member 404 may be replaced with a supporting member which is arranged in a ring shape along the overall periphery of the wafer W supported by the vacuum chuck 401. In this event, this supporting member may be independent of the vacuum chuck 401 so as not to rotate with the vacuum chuck 401, like the aforementioned supporting member, or may be configured to rotate with the vacuum chuck 401. In the latter case, the base of a height adjusting mechanism corresponding to the height adjusting mechanism 406 provided for the supporting member may be fixed to the vacuum chuck 401.

FIGS. 9(*a*) and 9(*b*) are diagrams schematically illustrating a supporting member of a polishing unit and a wafer W in a fourth embodiment of the polishing apparatus according to the present invention, and correspond to FIG. 7. The following description will be given of different aspects of the fourth embodiment of the present invention from the aforementioned third embodiment.

In the fourth embodiment, the supporting member 404 illustrated in FIG. 7 is replaced with a ring-shaped supporting member 501 made up of three independent supporting elements 501*a*, 501*b*, 501*c* sequentially arranged to surround the periphery of the wafer W, and separated at intervals of 120° from each other, used to support a portion of the polishing pad 201 which extends off toward the periphery of the wafer W, as illustrated in FIGS. 9(*a*) and 9(*b*). As illustrated in FIG. 9(*a*), the supporting element 501*a* has an arc shape, the inner peripheral surface of which fit to the periphery of the wafer W held by the vacuum chuck 401, and is comprised of a single member having a rectangular cross-section. The top surface of the supporting member 501 serves as part of a supporting surface for supporting a portion of the polishing pad 201 which extends off the edge of the wafer W, and generally forms a flat surface having the same level, i.e., substantially the same flat surface as a wafer holding surface in the vacuum chuck 401. The remaining supporting elements 501*b*, 501*c* are also configured in a similar manner to the supporting member 501*a*.

Since the supporting member 501 is configured as described above, moving mechanisms (not shown) are provided for the respective supporting elements 501*a*-501*c* for independently adjusting and setting the heights of the top surfaces of associated supporting elements, in addition to height adjusting mechanisms corresponding to the height adjusting mechanism 406 in FIG. 6. Each moving mechanism is configured to move the associated supporting element in parallel with the surface to be polished of the wafer W and in a radial direction about the wafer W such that the associated supporting element can be held at a first position shown in FIG. 9(*a*) and at a second position shown in FIG. 9(*b*). The height adjusting mechanisms and moving mechanisms in this embodiment can be implemented by known positioning mechanisms.

The moving mechanism provided for the supporting element 501*a* comprises a base unit directly or indirectly fixed to the vacuum chuck 401 or shaft 402; and a movable unit for fixing the height adjusting mechanism provided for the supporting element 501*a*. The height adjusting mechanism provided for the supporting element 501*a*, in turn, comprises a base unit directly or indirectly fixed to the moving mechanism provided for the supporting element 501*a*; and a movable unit for fixing the supporting element 501*a*. Therefore, in this embodiment, the supporting element 501*a*, moving mechanism, and height adjusting mechanism rotate together with the vacuum chuck 401. Moving mechanisms and height adjusting mechanism provided for the supporting elements 501*b*, 501*c*, respectively, are also configured individually in a similar manner. The operation of the respective moving mechanisms and height adjusting mechanisms is controlled by the control unit 208.

In the fourth embodiment of the present invention, the wafer W is loaded in the vacuum chuck 401 by the carrier robot, not shown, after the respective supporting elements 501*a*-501*c* have been moved to the second position, as illustrated in FIG. 9(*b*). Thus, the supporting elements 501*a*-501*c* will not impede the loading of the wafer W. With the wafer W held by the vacuum chuck 401, the displacement gage 103 measures a roll off quantity on the surface to be polished of the wafer W. The control unit 208 operates the height adjusting mechanisms provided to be associated with the supporting elements 501*a*-501*c*, respectively, from information based on the roll off quantity on the surface to be polished of the wafer W to adjust the heights of the top surfaces of the supporting elements 501*a*-501*c*, respectively, to set them to desired heights. The manner of setting these heights is similar to the setting of the height of the supporting member 404 in the third embodiment of the present invention. Subsequently, the control unit 208 controls the respective moving mechanisms to move the supporting elements 501*a*-501*c* to the first position illustrated in FIG. 9(*a*). As a result, no gap substantially exists between the inner peripheral side of the supporting elements 501*a*-501*c* and the periphery of the wafer W. This state is maintained until the polishing is finished.

Next, planarization processing is performed by polishing. The wafer W, which has been polished, is unloaded, and carried by the carrier robot (not shown) to a place, not shown, where a washing step and the like are performed. The wafer W is unloaded after the respective supporting elements 501*a*-501*c* have been moved to the second position, as illustrated in FIG. 9(*b*). As such, the wafer is readily unloaded because the respective supporting elements 501*a*-501*c* will not impede the unloading of the wafer W.

As will be understood from the foregoing description, the fourth embodiment of the present invention also produces advantages equivalent to those of the aforementioned third embodiment. Further, according to the fourth embodiment, the influence of the rebound of the polishing pad 201, which occur on the edge of the wafer W, can be reduced as compared with the third embodiment. Specifically, in the third embodiment, the gap G (see FIG. 6) exists between the supporting member 404 and the wafer W, so that this gap causes, though slight, the influence of the rebound of the polishing pad 201 which occurs on the edge of the wafer W. On the other hand, in the fourth embodiment, since the wafer W is polished with substantially no gap between the inner periphery of the supporting elements 501*a*-501*c* and the periphery of the wafer W, as illustrated in FIG. 9(*a*), it is possible to further reduce the influence of the rebound of the polishing pad 201 which occurs on the edge of the wafer W, further reduce the edge exclusion, and further improve the flatness of the wafer after the polishing. Also, according to the fourth embodiment, the wafer W is loaded and unloaded with the supporting elements 501*a*-501*c* spaced away from the periphery of the wafer W, as illustrated in FIG. 9(*b*), so that the wafer W can be readily load and unloaded.

It is also possible to reduce the influence of variations in roll off in the circumferential direction by adjusting the heights of the top surfaces of the supporting elements 501*a*-501*c*, respectively, from information based on the roll off quantities in the associated area Wa, Wb, We illustrated in FIG. 9(*b*) and set them to desired heights. For example, the height of the supporting element 501*a* is set to the height of the supporting surface corresponding to ΔROQ at an arbitrary position on the surface to be polished in the area Wa of the wafer W. Similarly, the height of the supporting element 501 is set to the height of the supporting surface corresponding to ΔROQ at an arbitrary position on the surface to be polished in the area Wb of the wafer W, and the height of the supporting element 501*c* is set to the height of the supporting surface corresponding to ΔROQ at an arbitrary position on the surface to be polished in the area Wa of the wafer W. However, instead of setting the height of the supporting surface in accordance with ΔROQ, the height of the supporting surface may be controlled in accordance with information based on the roll off quantity, and an arbitrary method can be used. For example, the height of the supporting surface may be set to the height of the supporting surface corresponding to an average of a plurality of ΔROQ's calculated from a roll off quantity on the surface to be polished in the area Wa of the wafer W, or to the height of the supporting surface corresponding to ROA at an arbitrary position in the area Wa of the wafer W, or to the height of the supporting surface corresponding to an average of a plurality of ROA's in the area Wa of the wafer W. These aspects are also applied to respective embodiments later described.

Further, as illustrated in FIG. 10, the respective supporting elements 501*a*-501*c* may be configured as members made up of a plurality of supporting pieces 501*a*1-501*a*4, 501*b*1-501*b*4, 501*c*1-501*c*4, capable of independently controlling the height of the supporting surface. In this way, it is possible to further suppress variations in the amount of polishing due to variations in roll off in the circumferential direction. Likewise, in the configuration illustrated in FIG. 10, each of supporting pieces 501*a*1-501*a*4, 501*b*1-501*b*4, 501*c*1-501*c*4, which make up the supporting elements 501*a*-501*c*, respectively, is provided with a moving element for moving the associated supporting piece in the radial direction centered at the wafer along the surface to be polished of the wafer, such that it is selectively held at the first position illustrated in FIG. 9(*a*) and at the second position illustrated in FIG. 9(*b*). Similarly, each of the supporting pieces 501*a*1-501*a*4, 501*b*1-501*b*4, 501*c*1-501*c*4 is provided with a height adjusting mechanism for independently setting the height of the supporting surface. As mentioned above, such height adjusting mechanisms and moving mechanisms can be implemented by known positioning mechanisms.

FIG. 11 is a diagram schematically illustrating a polishing section in cross-section and a control system in a fifth embodiment of the polishing apparatus according to the present invention, and corresponds to FIG. 6. In FIG. 11, components identical or corresponding to the components in FIGS. 2 and 4 are designated the same reference numerals, and repetitive description thereon is omitted. FIG. 11 illustrates that the polishing pad 201 extends off to its maximum to the right.

The following description will be given of different aspects of the fifth embodiment of the present invention from the third embodiment described with reference to FIG. 6. In the third embodiment of FIG. 6, the height of the supporting surface of the supporting member 404 is set to a desired height with reference to the information based on a roll off quantity on the surface to be polished of the wafer W to reduce variations in the amount of polishing due to variations in roll off. In the fifth embodiment of FIG. 11, on the other hand, a supporting pressure applied by the supporting member 404 to the polishing pad is set to a desired pressure by a pressure adjusting mechanism 601 using the information based on the roll off quantity on the surface to be polished of the wafer W to reduce variations in the amount of polishing due to variations in roll off.

An example of the pressure adjusting mechanism 601 is illustrated in FIG. 12. In FIG. 12, the pressure adjusting mechanism 601 comprises an air pressure cylinder 602 fixed to a base member 407; and a rod 603 of the air pressure cylinder 602, where the rod 603 has one end coupled to the supporting member 404. The supporting member 404 has one side surface coupled to a guide member for guiding the supporting member 404 in the axial direction of the rod 603. The pressure adjusting mechanism 601 can adjust a supporting pressure, with which the supporting member 404 is pressed against the polishing pad 201, to a desired value. As noted, the configuration of the pressure adjusting mechanism 601 is not limited to that illustrated in FIG. 12, but a variety of mechanisms may be employed.

In the fifth embodiment illustrated in FIG. 11, the supporting pressure of the supporting member 404 can be set by a similar method to that in the first embodiment previously described, and the control unit 208 sets the supporting pressure of the supporting member 404 to a predetermined contact pressure when the polishing pad 201 extends off the wafer W. However, the supporting pressure need not be applied when the polishing pad 201 does not extend off the wafer W, in which case the height of the supporting surface of the supporting member 404 may be held substantially the same as the wafer W by the pressure adjusting mechanism 601.

The same method as that previously described in connection with the first embodiment can be employed for previously establishing the relationship between ΔROQ and the supporting pressure such that the region inside the edge exclusion becomes flat. Similar to the first embodiment, the information on the relationship between ΔROQ and the supporting pressure such that the region inside the edge exclusion becomes flat is stored in the storage medium 209. The control unit 208 accesses the information on the relationship between ΔROQ and the supporting pressure previously established such that the region inside the edge exclusion becomes flat, stored in the storage medium 209, to control the supporting pressure based on the result of a measurement of a roll off quantity on the surface to be polished of the wafer, acquired by the displacement gage 103. The information stored in the storage medium 209 is the same as described in connection with the first embodiment. As mentioned above, the storage device 209 may be disposed physically independently of the control unit 208, or may be physically incorporated in the control unit 208.

Like the first embodiment, the fifth embodiment of the present invention can also provide the effect of reducing the influence on the wafer W due to the rebound of the polishing pad 201 of the polishing head 403 through the optimization in accordance with variations in the roll off quantity of the wafer W.

Now, a sixth embodiment of the polishing apparatus according to the present invention will be described with reference to FIG. 13. In this sixth embodiment, pressure adjusting mechanisms are provided instead of the height adjusting mechanisms for adjusting the heights of the supporting surfaces of the respective supporting elements 501*a*-501*c* in the polishing apparatus according to the fourth embodiment described with reference to FIG. 9. The following description will be given of different aspects of the sixth embodiment from the fourth embodiment of FIG. 9. In the fourth embodiment, the heights of the supporting surfaces of the respective supporting elements 501*a*-501*c* are set with reference to the information based on the roll off quantity on the surface to be polished of the wafer W to reduce variations in the amount of polishing due to variations in roll off. On the other hand, in the sixth embodiment illustrated in FIG. 13, supporting pressures applied to the polishing pad by the respective supporting elements 501*a*-501*c* are set to desired pressures by the pressure adjusting mechanisms provided to be associated with the respective supporting elements to reduce variations in the amount of polishing due to variations in roll off. A method of setting the supporting pressures of the respective supporting elements 501*a*-501*c* to desired pressures with reference to the information based on the roll off quantity on the surface to be polished of the wafer W is similar to those described in connection with the first embodiment, second embodiment, and fifth embodiment.

FIG. 13 is a diagram illustrating an exemplary configuration of a moving mechanism and the pressure adjusting mechanism in the sixth embodiment of the polishing apparatus according to the present invention, showing an example in which a moving mechanism 701 and a pressure adjusting mechanism 702 are provided for the supporting element 501*a* among the supporting elements 501*a*-501*c*. The remaining supporting elements 501*b*, 501*c* are provided with similar mechanisms.

The moving mechanism 701 provided for the supporting element 501*a* comprises an air cylinder 703, a coupling member 704, and a stopper 705. A cylinder body 706 of the air cylinder 703 is configured to be movable in the horizontal direction in FIG. 13, i.e., the radial direction of the wafer W, guided by the base member 407. The coupling member 704 couples the leading end of a piston rod 707 of the air cylinder 703 to the base member 407. The coupling member 704 also functions as a stopper for restricting movements of the cylinder body 706 to the right in FIG. 13. A position to which the cylinder body 706 is restricted by the coupling member 704 corresponds to the second position illustrated in FIG. 9(*b*). The stopper 705 is fixed to the base member 407, and operates to restrict movements of the cylinder 706 to the left in FIG. 13. The position to which the cylinder body 706 is restricted by the stopper 705 corresponds to the first position illustrated in FIG. 9(*a*).

Air-tight chambers 709, 710 defined by the piston 708 in the cylinder body 706 on both sides are communicated with air passages, not shown, respectively, such that these air passages can be utilized to switch, by a switching valve (not shown), between a state in which the air-tight chamber 709 is pumped to a vacuum, while the air-tight chamber 710 is open to the atmosphere, to move each of the supporting members 501*a*-501*c* to the first position (the position at which the cylinder body 706 abuts to the stopper 705) and a state in which the air-tight chamber 709 is open to the atmosphere, while the air-tight chamber 710 is pumped to a vacuum, to move the supporting elements 501*a*-501*c* to the second position (the position at which the cylinder body 706 abuts to the coupling member 704).

In the configuration illustrated in FIG. 13, the pressure adjusting mechanism 702 comprises an air-pressure cylinder 711 fixed to the cylinder body 706; a rod 712 of the air pressure cylinder 711; and a guide 713 for guiding vertical movements of the supporting element 501*a*, and the rod 712 has an upper end fixed to the supporting element 501*a*. By thus designing the pressure adjusting mechanism 702, a supporting pressure with which the supporting element 501*a* pushes up the polishing pad 201 can be adjust and set to a desired value. As appreciated, the configuration of the pressure adjusting mechanism 702 is not limited to that illustrated in FIG. 13, but a variety of other mechanisms may be used instead.

The sixth embodiment illustrated in FIG. 13 also provides similar advantages to those of the fifth embodiment. Further, according to the sixth embodiment, the influence of the rebound of the polishing pad, which occurs on the edge of the wafer W, can be reduced as compared with the fifth embodiment. Specifically, in the fifth embodiment, the gap G exists between the supporting member 404 and the wafer W, so that this gap causes, though slight, the influence of the rebound of the polishing pad 201 which occurs on the edge of the wafer W. On the other hand, in the sixth embodiment, since there is substantially no gap between the inner periphery of the respective supporting elements 501*a*-501*c* and the periphery of the wafer W, as is the case with the fourth embodiment, it is possible to further reduce the influence of the rebound of the polishing pad 201 which occurs on the edge of the wafer W, and further reduce the edge exclusion. Also, according to the sixth embodiment, the wafer W can be readily load and unloaded, as in the fourth embodiment. The influence due to variations in roll off in the circumferential direction can also be reduced by adjusting the supporting pressures of the respective supporting elements 501*a*-501*c* from the information based on the roll off quantities in the respective areas Wa-We of the wafer W illustrated in FIG. 9(*b*) and set them to desired pressures in a manner similar to the fourth embodiment.

In addition, like the fourth embodiment, variations in the amount of polishing due to variations in the roll off quantity in the circumferential direction can be further suppressed by making up each of the supporting elements 501*a*-501*c* of a plurality of supporting elements capable of independently controlling supporting pressures, and providing each supporting element with the pressure adjusting mechanism.

FIG. 14 is a diagram schematically illustrating a polishing section in cross-section and a control system in a seventh embodiment of the polishing apparatus according to the present invention. Like the first embodiment illustrated in FIG. 2, the polishing section comprises a top ring and a polishing table. FIG. 14 schematically illustrates a cross-sectional view of part of the top ring 52 and polishing table 54 and an example of a control system. In FIG. 14, components identical or corresponding to those in FIG. 2 are designated the same reference numerals, and repetitive description thereon is omitted. Therefore, the following description will be centered on different aspects of the seventh embodiment from the first embodiment.

First, in the seventh embodiment, the top ring 52 has an air bag 802 concentrically divided into a plurality of compartments, instead of the single air bag 202 in FIG. 2, and appears to be a profile control type top ring. The top ring 52 has four air bags: a central discoid air bag Z1, a toroidal air bag Z2 surrounding the air bag Z1, a toroidal air bag Z3 surrounding the air bag Z2, and a toroidal air-bag Z2 surrounding the air bag Z3. Pressing pressures to areas of the wafer W served by the respective airbags can be independently adjusted by controlling air pressures in the respective airbags. When one wishes to reduce the polishing rate in an edge zone of the wafer W, the air pressure of the air bag Z4 may be reduced by the pressure adjusting mechanism 806 to reduce the pressing pressure of a pressing section which serves for the edge zone. The pressing pressure is generally substantially the same pressure as the air pressure.

In this way, with the use of the profile control type top ring as illustrated in FIG. 14, a radial distribution of the polishing rate can be controlled by adjusting the air pressures of the respective air bags. Consequently, variations in roll off can be coped with by adjusting the pressing pressures of the pressing section serving for an edge zone of a wafer in accordance with the roll off. In the following description, the pressing section serving for an edge zone of the wafer is called the "edge area".

Here, a description will be given of an example of a method of setting the pressing pressure at the edge area, i.e., the air pressure of the air bag Z4. For convenience of description, assume that pressing pressures of pressing sections except for that associated with the edge area (i.e., respective air pressures of the air bags Z1, Z2, Z3) are the same as the pressing contact pressure by the retainer ring, and the pressing pressure at the edge area is represented as a relative value for the pressure. Assume that the roll off quantity of the surface to be polished of the wafer W is ROQ0 at the center of the wafer, and ROQ1 at a location spaced by 1 mm from the wafer edge. ROQ1 may be an average value of those at several points on the wafer W in the circumferential direction, or a value at only one point used as a representative value.

First, a difference ΔROQ=ROQ1−ROQ0 is calculated between the roll off quantity at the location spaced by 1 mm from the wafer edge and the roll off quantity at the center of the wafer. Next, a pressing pressure corresponding to the calculated ΔROQ is found based on a previously established relationship between ΔROQ and the edge area pressing pressure such that a region inside the edge exclusion becomes flat after polishing. Finally, the control unit 208 sets the air pressure of the air bag Z4 to the pressure which has been found in the foregoing.

Here, a description will be given of an example of a method of previously establishing the relationship between ΔROQ and the edge area pressing pressure such that the region inside the edge exclusion becomes flat. FIG. 15 shows the relationship between relative values of a maximum polishing rate and a minimum polishing rate and the pressing pressure at the edge area (edge area pressing pressure) when the edge exclusion is chosen to be 2 mm on a wafer with ΔROQ=0.5 μm. In general polishing, a geometrically perfect flat surface cannot be created, but in semiconductor device manufacturing processes, for example, a lithographic process and the like, polishing to a practically sufficient flatness is sufficient. Therefore, assume in the following description that a surface polished to such a practically sufficient flatness is called a "flat surface." Also, it has been empirically recognized that by selecting an appropriate value for an allowance for variations in the polishing rate, a surface to be polished after polishing can have a sufficient flatness. Therefore, it can be said that when both the maximum polishing rate and minimum polishing rate fall within the allowance for variations in the polishing rate, the region inside the edge exclusion will become flat after polishing. As such, in the scenario of FIG. 15, when the allowance for variations in the polishing rate is chosen to be, for example, 1.0±0.1 in relative value of the polishing rate, it can be seen that the region inside the edge exclusion will become flat if the pressing pressure at the edge area is set between approximately 0.80 times and 0.94 times higher than the polishing pressure.

A different ΔROQ will result in a different relationship between the relative values of the maximum polishing rate and minimum polishing rate and the edge area pressing pressure. Therefore, when the pressing pressure at the edge area has been found in the foregoing manner for each ΔROQ, the relationship between ΔROQ and the edge area pressing pressure can be previously established such that the region inside the edge exclusion will become flat. However, since it is difficult to calculate the edge area pressing pressures for all ΔROQ, the edge area pressing pressures are actually calculated for ΔROQ at several points, and are interpolated between these points using an interpolation equation.

The foregoing example of setting the edge area pressing pressure uses the difference ΔROQ between the roll off quantity at the location spaced by 1 mm from the wafer edge and the roll off quantity at the center of the wafer. However, the setting of the edge area pressing pressure is not limited to the setting with reference to the foregoing ΔROQ, but the setting may be made with reference to ROA described in Non-Patent Document 2, or a coefficient when the roll off quantity is approximated by an approximation equation such as a polynomial, as long as it is information based on the roll off quantity.

Information on the relationship between ΔROQ and the edge area pressing pressure previously established such that the region inside the edge exclusion will become flat is stored in a storage medium 209. Thus, control unit 208 controls the edge area pressing pressure based on the result of measuring a roll off quantity on a surface to be polished of a wafer W, acquired by the displacement gage 103, with the information on the relationship between ΔROQ and the edge area pressing pressure previously established such that the region inside the edge exclusion will become flat, and a program for accessing the information. The storage medium 209 may store, other than the aforementioned information and program, a program for controlling the edge area pressing pressure based on the result of measuring the roll off quantity on the surface to be polished of the wafer W, acquired by the displacement gage 103. The storage medium 209 can also store a program for controlling the aforementioned motors in the respective components, displacement gage 103, and carrier robots. The storage medium 209 may be physically independent of the control unit 208 or may be physically incorporated in the control unit 208.

As will be understood from the foregoing description, in the seventh embodiment of the present invention, the influence of the rebound of the polishing pad 201 on the wafer W can be reduced by optimizing the edge area pressing pressure in accordance with variations in the roll off quantity of the wafer W.

The foregoing description has been made using a top ring having four concentrically partitioned air bags. However, the profile control type top ring is a generic name for top rings having a plurality of pressing compartments. Specifically, one having a plurality of pressing portions using air backs or water backs concentrically partitioned by a plurality of membranes, one having a plurality of portions directly pressing the rear surface of a wafer by air pressure by applying pressure to zoned air chambers separately, one having a portion for generating a pressure with a spring, one having local pressing sections by disposing one or a plurality of piezo-electric elements, or a combination thereof may be used as the profile control type top ring.

Here, the air back means back pressure generated by air for pressing a wafer and is not limited to an air bag as applying means. Similarly, the water back means back pressure generated by a fluid (water) for pressing a wafer and is not limited to a water bag as applying means.

FIG. 16 is a diagram schematically illustrating a polishing section in cross-section and an associated control system in an eighth embodiment of the polishing apparatus according to the present invention. The eighth embodiment of the present invention is a combination of the first embodiment with the seventh embodiment. Specifically, the eighth embodiment of the present invention can reduce variations in the polishing rate due to variations in roll off by adjusting and optimizing both the pressing contact pressure of the retainer ring and the pressing pressure at the edge area.

Here, a description will be given of an example of a method of setting the pressing contact pressure of the retainer ring 203 and the pressing pressure at the edge area (i.e., the air pressure of the air bag Z4). Assume that the roll off quantity of the surface to be polished of the wafer W is ROQ0 at the center of the wafer, and ROQ1 at a location spaced by 1 mm from the wafer edge. ROQ1 may be an average value of those at several points on the wafer W in the circumferential direction, or a value at only one point used as a representative value.

First, a difference ΔROQ=ROQ1−ROQ0 is calculated between the roll off quantity at the location spaced by 1 mm from the wafer edge and the roll off quantity at the center of the wafer. Next, a pressing contact pressure of the retainer ring 203 and a pressing pressure in the edge area, corresponding to the calculated ΔROQ, are found based on a previously established relationship between ΔROQ, the pressing contact pressure of the retainer ring and the edge area pressing pressure such that a region inside the edge exclusion becomes flat after polishing. Finally, the control unit 208 sets the pressing contact pressure of the retainer ring 203 and the air pressure of the air bag Z4 to the pressure found in the foregoing.

Here, a description will be given of an example of a method of previously establishing the relationship between ΔROQ and the pressing contact pressure of the retainer ring and the edge area pressing pressure such that the region inside the edge exclusion becomes flat. FIG. 17 shows the relationship between the pressing contact pressure of the retainer ring and the edge area pressing pressure when relative values of a maximum polishing rate and a minimum polishing rate fall within the allowance 1.0±0.1 for variations in the polishing rate when the edge exclusion is chosen to be 2 mm on a wafer with ΔROQ=0.5 μm. FIG. 17 is a diagram of the relationship which is found by varying the pressing contact pressure of the retainer ring and the pressing pressure at the edge area while maintaining unchanged the pressing pressures of pressing sections (i.e., respective air pressures of the air bags Z1, Z2, Z3) except for the edge area.

Specifically, an experimental design is used to design combinations of the pressing contact pressure of the retainer ring and the pressing pressure at the edge area. Next, numerical analysis using the finite element method is used to obtain a contact pressure distribution in each combination so as to find a minimum relative contact pressure and a maximum relative contact pressure at the inside of the edge exclusion. The minimum relative contact pressure and the maximum relative contact pressure become respectively a relative value of a minimum polishing rate and a relative value of a maximum polishing rate. Then, the response surface methodology is used to obtain the pressing contact pressure of the retainer ring and the pressing pressure at the edge area so that the relative values of the minimum relative polishing rate and the maximum relative polishing rate are within 1.0±0.1. In the above-described procedures, a commercially available software, for example, MINITAB produced by Minitab Inc., can be used for the experimental design and the response surface methodology.

As previously described, the region inside the exclusion becomes flat after polishing if both the maximum polishing rate and minimum polishing rate fall within the allowance for the polishing rate. Therefore, in the scenario of FIG. 17, the region inside the edge exclusion will become flat after polishing if the pressing contact pressure of the retainer ring and the edge area pressing pressure fall within the hollow area.

A different ΔROQ will result in a different relationship between the pressing contact pressure of the retainer ring and the edge area pressing pressure in which the relative values of the maximum polishing rate and minimum polishing rate fall within the allowance for variations in the polishing rate. Therefore, when the pressing contact pressure of the retainer ring and the edge area pressing pressure have been found in the foregoing manner for each ΔROQ, the relationship between ΔROQ, the pressing contact pressure of the retainer ring, and the edge area pressing pressure can be previously established such that the region inside the edge exclusion will become flat. However, since it is difficult to calculate the pressing contact pressures of the retainer ring and the edge area pressing pressure for all ΔROQ, the pressing contact pressures of the retainer ring and the edge area pressing pressures are actually calculated for ΔROQ at several points, and are interpolated between these points using an interpolation equation.

The foregoing example of setting the pressing contact pressure of the retainer ring and the edge area pressing pressure uses the difference ΔROQ between the roll off quantity at the location spaced by 1 mm from the wafer edge and the roll off quantity at the center of the wafer. However, the setting of the edge area pressing pressure is not limited to the setting with reference to the foregoing ΔROQ, but the setting may be made with reference to ROA described in Non-Patent Document 2, or a coefficient when the roll off quantity is approximated by an approximation equation such as a polynomial, as long as it is information based on the roll off quantity.

Information on the relationship between ΔROQ, the pressing contact pressure of the retainer ring, and the edge area pressing pressure previously established such that the region inside the edge exclusion will become flat is stored in a storage medium 209. Thus, the control unit 208 controls the pressing contact pressure of the retainer ring and the edge area pressing pressure based on the result of measuring a roll off quantity on a surface to be polished of a wafer W, acquired by the displacement gage 103, with the information on the relationship between ΔROQ, the pressing contact pressure of the retainer ring, and the edge area pressing pressure previously established such that the region inside the edge exclusion will become flat, and a program for accessing the information. The storage medium 209 may store, other than the aforementioned information and program, a program for controlling the pressing contact pressure of the retainer ring and the edge area pressing pressure based on the result of measuring the roll off quantity on the surface to be polished of the wafer W, acquired by the displacement gage 103. The storage medium 209 can also store a program for controlling the aforementioned motors in the respective components, displacement gage 103, and carrier robots. The storage medium 209 may be physically independent of the control unit 208 or may be physically incorporated in the control unit 208.

As will be understood from the foregoing description, in the eighth embodiment of the present invention, the influence of the rebound of the polishing pad 201 on the wafer W can be reduced by optimizing the pressing contact pressure of the retainer ring and the edge area pressing pressure in accordance with variations in the roll off quantity of the wafer W.

The foregoing description has been so far given of the method and apparatus for reducing variations in the polishing rate due to variations in roll off by optimizing the supporting pressure on the supporting surface of the supporting member (pressing contact pressure of the retainer ring), the height of the supporting surface, the pressing pressure at the edge area in the profile control type top ring, and the like. Though the polishing member has not been so far referred to, it has now been found that a change in polishing rate resulting from a change in supporting pressure or the like largely affects the modulus of elasticity (compression modulus, or Young's modulus) and the thickness of the polishing member. Accordingly, as a result of diligent studies, it has been found that there are ranges for the modulus of elasticity and the thickness of a polishing material suitable for polishing with a practically sufficient flatness by these methods. In order to find out the elastic modulus and thickness of an appropriate polishing member, calculation conditions were designed by the experimental design and the results thereof were analyzed by the response surface methodology.

FIG. 18 is a diagram showing a ranges for the modulus of elasticity and thickness of a suitable polishing member in a single-layer pad. A hollow area represents ranges for the modulus of elasticity and thickness suitable for the method of the present invention, in which the relative value of the maximum polishing rate is equal to or lower than 1.1, and the relative value of the minimum polishing rate is equal to or higher than 0.9. This range is expressed by Equation 1 and Equation 2:

$$0.9 \leqq 0.88+0.0336Y+0.000259X-0.0063Y^2-0.000021X^2+0.0004XY, \quad \text{Equation 1}$$

$$1.1 \geqq 1.19-0.153Y+0.0022X+0.025Y^2+0.000032X^2-0.00041XY \quad \text{Equation 2}$$

where X is the modulus of elasticity [MPa], and Y is the thickness [mm]. The hollow area represents the ranges for the modulus of elasticity and the thickness which satisfy Equation 1 and Equation 2.

FIG. 19 is a diagram which similarly shows suitable ranges for the modulus of elasticity and the thickness of a polishing member in a single-layer pad. A hollow area represents a range in which the relative value of the maximum polishing rate is equal to or lower than 1.06, and the relative value of the minimum polishing rate is equal to or higher than 0.94, and represents more suitable ranges for the modulus of elasticity and thickness for the method of the present invention. This range is expressed by Equation 3 and Equation 4:

$$0.94 \leqq 0.88+0.0336Y+0.000259X-0.0063Y^2-0.000021X^2+0.0004XY, \quad \text{Equation 3}$$

$$1.06 \geqq 1.19-0.153Y+0.0022X+0.025Y^2+0.000032X^2-0.00041XY \quad \text{Equation 4}$$

where X is the modulus of elasticity [MPa], and Y is the thickness [mm]. The hollow area represents the ranges for the modulus of elasticity and thickness which satisfy Equation 3 and Equation 4.

FIG. 20 is a table showing the relative value of the maximum polishing rate and the relative value of the minimum polishing rate when numerical analyses were made on the modulus of elasticity and the thickness of the single-layer pad, selected from the hollow areas in FIGS. 18 and 19. It can be seen that the maximum polishing rate and minimum polishing rate fall within a range of the desired polishing rate when the modulus of elasticity and the thickness are selected from the hollow areas in FIGS. 18 and 19.

FIGS. 21 to 24 are examples of diagrams showing suitable ranges for the modulus of elasticity and the thickness of a polishing member in a two-layer pad. Assume herein that a layer in contact with an object under polish is called an "upper pad layer," and the other one a "lower pad layer." It is understood that in the two-layer pad, the thickness of the lower pad layer does not significantly affect a change in the polishing rate resulting from a change in the supporting pressure or the like. Therefore, as a suitable two-layer pad for the method of the present invention, ranges for the modulus of elasticity Xu [MPa] of the upper pad layer, the thickness Yu [mm] of the upper pad layer, and the modulus of elasticity Xd [MPa] of the lower pad layer satisfy:

$$0.9 \leqq 0.763-0.0031Xu+0.0281Xd+0.0323Yu+0.000018Xu^2-0.0008Xd^2-0.0017Yu^2+0.00011XuXd+0.000097XuYu-0.0017XdYu, \text{ and} \quad \text{Equation 5}$$

$$0.9 \leqq 0.877+0.0023Xu+0.055Yu+0.0000055Xu^2+0.00032Xd^2-0.0052Yu^2-0.000099XuXd+0.00072XuYu-0.00137XdYu \leqq 1.1 \quad \text{Equation 6}$$

FIG. 21 is an example of a range which satisfies Equation 5 and Equation 6. A hollow area in FIG. 21 shows suitable ranges for the modulus of elasticity and the thickness of the upper pad layer when the modulus of elasticity of the lower pad layer is fixed at 12 MPa. FIG. 22 in turn shows another example of a range which satisfies Equation 5 and Equation 6. A hollow area in FIG. 22 show suitable ranges for the modulus of elasticity of the lower pad layer, and the thickness of the upper pad layer when the modulus of elasticity of the upper pad layer is fixed at 10 MPa.

Also, as a further suitable two-layer pad for the method of the present invention, ranges for the modulus Xu of elasticity [MPa] of the upper pad layer, the thickness Yu [mm] of the upper pad layer, and the modulus Xd of elasticity [MPa] of the lower pad layer satisfy:

$$0.94 \leqq 0.763-0.0031Xu+0.0281Xd+0.0323Yu+0.000018Xu^2-0.0008Xd^2-0.0017Yu^2+0.00011XuXd+0.000097XuYu-0.0017XdYu, \text{ and} \quad \text{Equation 7}$$

$$0.94 \leqq 0.877+0.0023Xu+0.055Yu+0.0000055Xu^2+0.00032Xd^2-0.0052Yu^2-0.000099XuXd+0.00072XuYu-0.00137XdYu \leqq 1.06 \quad \text{Equation 8}$$

FIG. 23 is an example of a range which satisfies Equation 7 and Equation 8. A hollow area in FIG. 23 shows suitable ranges for the modulus of elasticity of the upper pad layer and the thickness of the upper pad layer when the modulus of elasticity of the lower pad layer is fixed at 12 MPa. FIG. 24 in turn is another example of a range which satisfies Equation 7 and Equation 8. A hollow area in FIG. 24 shows suitable ranges for the modulus of elasticity of the lower pad layer and the thickness of the upper layer pad when the modulus of elasticity of the upper pad layer is fixed at 10 MPa.

FIG. 25 is a table showing the relative value of the maximum polishing rate and the relative value of the minimum polishing rate when numerical analyses are made on the modulus of elasticity of the upper pad layer, the modulus of elasticity of the lower pad layer, and the thickness of the upper pad layer of a two-layer pad selected from the hollow areas in FIGS. 21 to 24. It is understood that the maximum polishing rate and minimum polishing rate fall under a desired polishing rate when the modulus of elasticity of the upper pad layer, the modulus of elasticity of the lower pad layer, and the thickness of the upper pad layer are selected from the hollow areas in FIGS. 21 to 24. This is also applied when the modulus of elasticity of the upper pad layer, the modulus of elasticity of the lower pad layer, and the thickness of the upper pad layer are selected from a range which satisfies Equation 5 and Equation 6, or from a range which satisfies Equation 7 and Equation 8.

FIG. 26 is a diagram showing a contact pressure distribution on a surface to be polished when the optimization was performed in accordance with the present invention, and a contact pressure distribution of the same when the optimization was not performed, derived from numerical analyses, when a wafer having a radius of 150 mm with a roll off ΔROQ=0.5 μm was polished using a two-layer pad. In FIG. 26, a solid line represents a contact pressure distribution when the modulus of elasticity of the upper pad layer, the modulus of elasticity of the lower pad layer, and the thickness of the upper pad layer were selected from a range which satisfies Equation 7 and Equation 8, and the retainer ring pressure and the pressing pressure at the edge area were optimized. A broken line in turn represents a contact pressure distribution when the modulus of elasticity and the thickness of the polishing member were out of the suitable range, and the retainer ring pressure and pressing pressure in the edge area were not optimized but set to the same pressure as the pressing pressure at the center of the wafer.

When the edge exclusion is chosen to be 2 mm, a "flat surface" results from polishing, as previously described, if variations in contact pressure distribution inside the radius of 148 mm fall within the allowance. Also, the contact pressure distribution should be as flat as possible inside the radius of 148 mm. Assume herein that the allowance for the contact pressure distribution is 1.0±0.1 in relative value. When the optimization is not performed, the relative surface contact exceeds 1.1 inside the radius of 148 mm, so that a "flat surface" does not result after polishing. On the other hand, when the optimization is performed, the relative contact pressure falls within 1.0±0.1 inside the radius of 148 mm, presenting a very flat contact pressure distribution. Consequently, a "flat surface" results after polishing.

While the first to eighth embodiments of the polishing apparatus according to the present invention have been described above, such a polishing apparatus, when applied to a semiconductor device manufacturing method, can advantageously improve a chip yield in a CMP process, and manufacture semiconductor devices at a lower cost as compared with conventional semiconductor device manufacturing methods.

While embodiments of the polishing apparatus according to the present invention have been described above, the present invention is not limited to such embodiments. For example, in the present invention, a plurality of polishing sections can be provided. This can advantageously process more wafers within a predetermined time period. Also, when a plurality of polishing sections are used separately for rough polishing and for finish polishing, polishing conditions can be adaptively set for each of rough polishing and finish polishing in selecting a polishing assistant, a polishing pad, a rotational speed of the vacuum chuck, a rotational speed of the polishing head, a pressing pressure of the polishing head, and the like, thus efficiently polishing wafers for planarization.

When rough polishing and finish polishing are performed separately in different polishing sections in a polishing apparatus having a plurality of polishing sections, the rough polishing is followed by the finish polishing, so that the height or supporting pressure of the supporting member in the polishing section for the finish polishing is preferably set in anticipation of a change in the roll off quantity due to the rough polishing. Specifically, the height or supporting pressure of the supporting member is preferably set in the polishing section for the finish polishing with reference to a roll off quantity which is calculated by subtracting the amount of polishing by the rough polishing from a roll off quantity of a surface to be polished of a wafer W, measured by the displacement gage 103. However, the amount of polishing by the rough polishing may not be necessarily anticipated for setting the height of the supporting member in the polishing section for the finish polishing.

Also, in the present invention, the storage device 209 may be physically independent of the control unit 208, or may be physically incorporated in the control unit 208.

INDUSTRIAL AVAILABILITY

As will be understood from the foregoing description on the first to eighth embodiments of the polishing apparatus according to the present invention, the present invention can provide a polishing apparatus and a polishing method which can polish wafers at a high yield rate even if the roll off exists. Further, the present invention can provide a semiconductor device manufacturing method for manufacturing semiconductor devices at a low cost by means of using the polishing apparatus and the polishing method as described above.

The invention claimed is:

1. A polishing method for polishing a wafer, said method comprising:

acquiring information indicative of a roll off quantity of the wafer, the roll off quantity being a set of distances between a reference line and points on a surface to be polished of the wafer, the reference line passing a reference point and being substantially parallel to the surface to be polished of the wafer;

calculating a desired value for a supporting pressure for supporting an extending portion of a polishing pad by using the information;

holding the wafer with a holding member;

pressing a retainer ring of the holding member against at least part of the extending portion of the polishing pad and adjusting a pressure on the retainer ring by using the calculated desired value; and polishing the wafer by applying a pressure between the polishing pad and the wafer held by the holding member while moving said polishing pad relative to the wafer.

2. A semiconductor device manufacturing method comprising planarizing a surface of a wafer using a polishing apparatus, the polishing apparatus comprising:

a polishing section having a polishing pad and a holding member for holding a wafer, the polishing section being provided for polishing the wafer held by the holding member by applying a pressure between said polishing pad and the wafer while moving said polishing member relative to the wafer;

a retainer ring attached to said holding member, the retainer ring having a supporting surface for supporting at least part of a portion of said polishing pad which extends off the wafer during polishing of the wafer;

a pressure adjusting mechanism for adjusting a pressure on the supporting surface of said retainer ring; and a control unit for controlling said pressure adjusting mechanism to bring the pressure on said supporting surface of said retainer ring to a desired pressure using information based on a roll off quantity of the wafer, the roll off quantity being a set of distances between a reference line and points on a surface to be polished of the wafer, the reference line passing a reference point and being substantially parallel to the surface to be polished of the wafer.

3. A semiconductor device manufacturing method comprising:

planarizing a surface of a wafer using the polishing method of claim 1.

* * * * *